US008951018B1

(12) United States Patent
Calamia et al.

(10) Patent No.: US 8,951,018 B1
(45) Date of Patent: Feb. 10, 2015

(54) VARIABLE PITCH PROPELLER AND ASSOCIATED PROPELLER BLADE

(75) Inventors: Dave Calamia, Burlington, WI (US); Gerald Ewens, Pleasant Prairie, WI (US); John Charles Scott, Lake Villa, IL (US); John Valek, Winthrop Harbor, IL (US); Richard McChesney, Waukegan, IL (US); Mark C. Noble, Pleasant Prairie, WI (US)

(73) Assignee: BRP US Inc., Sturtevant, WI (US)

( * ) Notice: Subject to any disclaimer, the term of this patent is extended or adjusted under 35 U.S.C. 154(b) by 744 days.

(21) Appl. No.: 13/016,569

(22) Filed: Jan. 28, 2011

Related U.S. Application Data

(60) Provisional application No. 61/299,657, filed on Jan. 29, 2010.

(51) Int. Cl.
*B63H 1/26* (2006.01)

(52) U.S. Cl.
USPC ..... 416/228; 416/244 B; 440/50

(58) Field of Classification Search
CPC ..... B63H 1/14; B63H 1/20; B63H 1/26; B63H 3/00
USPC ..... 416/223 R, 228, 234, 239, 244 B, 248, 416/142, 147; 440/49, 50
See application file for complete search history.

(56) References Cited

U.S. PATENT DOCUMENTS

| | | | | | |
|---|---|---|---|---|---|
| 701,242 | A | * | 5/1902 | Aegerter | 416/228 |
| 2,352,186 | A | | 6/1944 | Corrigan | |
| 2,554,716 | A | * | 5/1951 | Melius | 416/168 R |
| 2,599,598 | A | * | 6/1952 | Wirkkala | 416/228 |
| 3,295,610 | A | | 1/1967 | Frias | |
| 3,380,536 | A | | 4/1968 | Pehrsson et al. | |
| 4,028,004 | A | | 6/1977 | Wind | |
| 4,076,453 | A | | 2/1978 | Feroy | |
| 4,304,524 | A | * | 12/1981 | Coxon | 416/131 |
| 5,017,090 | A | * | 5/1991 | Morrison | 416/168 R |
| 5,219,272 | A | * | 6/1993 | Steiner et al. | 416/139 |
| 5,326,223 | A | * | 7/1994 | Speer | 416/46 |
| 5,354,176 | A | | 10/1994 | Schilling et al. | |
| 5,494,406 | A | | 2/1996 | Takada et al. | |
| 5,593,280 | A | | 1/1997 | Takada et al. | |
| 5,611,665 | A | | 3/1997 | Angel | |
| 5,816,869 | A | | 10/1998 | Willows | |
| 5,916,003 | A | | 6/1999 | Masini et al. | |

(Continued)

FOREIGN PATENT DOCUMENTS

WO 2009109912 A1 9/2009

OTHER PUBLICATIONS

Helseth [online], [retrieved on Feb. 15, 2011], Retrieved from Internet< URL: http://www.helseth.no/products.html>.
Man Diesel & Turbo [online], [retrieved on Feb. 15, 2011], Retrieved from Internet:< URL: http://www.mandieselturbo.com/0000301/Press/Pictures/Marine-Power/Propeller-Equipement.html>.
Schottel Rudderpropeller, The Superior Propulsion Systems, catalog, 8 pages, Aug. 2010, Schottel GmbH, Spay/Rhein, Germany.

(Continued)

*Primary Examiner* — Edward Look
*Assistant Examiner* — Danielle M Christensen
(74) *Attorney, Agent, or Firm* — BCF LLP

(57) ABSTRACT

A variable pitch propeller comprises a plurality of blades pivotally connected to a hub. Each of the plurality of blades has a base having a leading end and a trailing end. The trailing edge has a notch therein forming a discontinuity in a profile of the trailing edge. The notch is sized and shaped so as to accommodate passage therethrough of a portion of the leading edge of an adjacent blade when the blade and the adjacent blade are pivoted. A blade for a variable pitch propeller is also presented.

10 Claims, 16 Drawing Sheets

(56) References Cited

U.S. PATENT DOCUMENTS

| | | | | |
|---|---|---|---|---|
| 6,247,897 | B1 * | 6/2001 | Patel | 416/197 R |
| 6,371,726 | B1 | 4/2002 | Jonsson et al. | |
| 6,506,019 | B2 * | 1/2003 | Lin et al. | 416/93 A |
| 7,156,707 | B2 | 1/2007 | Rosenkranz et al. | |
| 7,357,686 | B2 * | 4/2008 | Lin et al. | 440/50 |
| 7,637,722 | B1 | 12/2009 | Koepsel et al. | |
| 2004/0157509 | A1 * | 8/2004 | Willmot | 440/50 |
| 2010/0187826 | A1 | 7/2010 | Carr | |

OTHER PUBLICATIONS

Schottel CP Propeller, Reliable and Powerful, catalog, 12 pages, Aug. 2010, Schottel-Schiffsmaschinen GmbH, Wismar, Germany.

Wartsila Controllable Pitch Propellers, catalog, 12 pages. 2008, Wartsila, Helsinki, Finland.

Just Five Weeks, Marine News p. 23, 1 page. Jan. 2004, Wartsila.

http:www.nauticexpo.com/boat-manufacturer/variable-pitch-propeller-1966.html, retrieved Jan. 28, 2011.

LIPS CP Propellers, Controllable Pitch Propeller Solutions, catalog, 12 pages, Apr. 2005, Wartsila.

* cited by examiner

VARIABLE PITCH PROPELLER AND ASSOCIATED PROPELLER BLADE

CROSS-REFERENCE

The present application claims priority to U.S. Provisional Patent Application No. 61/299,657, filed Jan. 29, 2010, and entitled "Blade for a Variable Pitch Propeller", the entirety of which is incorporated herein by reference.

TECHNICAL FIELD

The present invention relates to blades for variable pitch propellers for marine applications.

BACKGROUND

Many boats and other watercraft are propelled by one or more inboard or outboard engines or a stern drive system, which drives one or more propellers. Each propeller typically has three or four blades, but may have as few as two or as many as five or six. The base of each blade is mounted at an angle, or pitch angle, relative to a radial plane transverse to the axis of rotation of the propeller shaft. Propellers may be constructed with blades having a fixed pitch. The fixed pitch is typically when the propeller blades are fixed at a pitch angle that provides maximum efficiency at a designated operating condition. Fixed pitch propellers typically have a reduced efficiency at operating conditions other than those designed for. Alternatively, the pitch of a propeller can be fixed to provide better acceleration or pulling capacity at lower speeds, which typically results in a reduced top speed. As a result, fixed pitch propellers typically are a compromise between acceleration, a boat velocity and fuel consumption.

One way to improve the efficiency of propellers at most speeds is to provide a propeller with blades having a variable pitch angle. This type of propeller has therefore a variable pitch and is called variable pitch propeller. One example of a variable pitch propeller is described in U.S. Pat. No. 6,896,564, which is incorporated herein by reference in its entirety. FIG. 8 shows typical blades 300' of a variable pitch propeller 54'. The blades 300' are pivotally connected to a hub 94' for rotating about their pitch axis 102'. An actuator (not shown in that figure) is linked to the blades 300' to pivot them between a first pitch angle and a second pitch angle at which actuation of the propeller assembly 54' produces forward thrusts of different strength (positive pitch). In a few cases, the first pitch angle produces a forward thrust, and the second pitch angle produces a rearward thrust (negative pitch) to the watercraft.

To avoid interferences between adjacent blades 300' during pivoting, the blades 300' usually have a smaller chord 347' at the hub and a smaller tip area 301' than the blades mounted on typical conventional outboard engine fixed propellers. However, a longer chord at the hub and a larger tip area are desirable as they maximize the available surface area of the blade and thus create a greater thrust, and favour flow control. Controlling the flow of water at the tip of the blade, and especially at the trailing edge, is critical for minimizing cavitation and losses when operating at high rpm.

In addition, the blades of conventional variable pitch propellers are secured to the hub of the propeller by one or more screws inserted into threaded apertures located at the base of the blade. The threaded ends of the screws are engaged in the blade, while the heads of the screws are in the hub. That way the screws are not apparent on the blade. While this arrangement does secure the blades to the hub, it makes it difficult for the user to replace a damaged blade from the propeller. To detach the blade from the hub, the user has to first disassemble the hub in order to access the screws, before being able to unscrew the blade from the hub.

Therefore, while conventional variable pitch propellers are adequate for their purposes, there is nonetheless room for improvement in the art.

SUMMARY

It is an object of the present invention to ameliorate at least some of the inconveniences present in the prior art.

In one aspect, a variable pitch propeller suitable for use in association with a marine internal combustion engine is provided. The propeller comprises a hub and a plurality of blades. Each of the plurality of blades is pivotally connected to the hub so as to pivot about a pitch axis between a positive pitch angle and a negative pitch angle. Each of the plurality of blades has a base having a leading end and a trailing end. A leading edge has a distal end and a proximal end. The proximal end of the leading edge connects the leading end of the base. A trailing edge has a distal end and a proximal end. The distal end of the trailing edge connects the distal end of the leading edge. The proximal end of the trailing edge connects the trailing end of the base. The trailing edge has a notch therein forming a discontinuity in a profile of the trailing edge. The notch is sized and shaped so as to accommodate passage therethrough of a portion of the leading edge of an adjacent blade when the blade and the adjacent blade are pivoted between the positive pitch angle and the negative pitch angle. The propeller has a diameter of less than 40 inches.

Thus aspects of the invention provide a variable pitch propeller having blades with a notch (i.e. a small indentation) in their trailing edges. The notch forms a discontinuity in the profile of both the blade and the trailing edge. The notch is shaped and sized to accommodate the proximal end of the leading edge of an adjacent blade, thereby preventing interference between adjacent blades during pass-by. Were the notch not present, the adjacent blades would collide during rotation about their pitch axis. Various propeller blades of the prior art do not incorporate such notch or such discontinuity. Rather, the whole trailing edge is designed to prevent interference between blades, thus leaving little room for optimization of other factors, for example those effecting propeller performance, when designing the blade. One of those other factors relates to diminishing a load at the tip of the blade. In a rounded ear profile (large tip area), water pressure is more uniformly distributed on the blade's tip area, and the flow of water is more controlled at the tip of the blade. Therefore blades with rounded tips are usually of a preferred choice. Such blades are commonly seen in conventional outboard engines, but are too bulky to be used in variable pitch propeller engines. If such rounded ear propeller blades were allowed to pivot, they would (obviously undesirable) collide with each other. As a consequence, blades traditionally used in variable pitch propellers have straight trailing edges and 'pointy' tips (also known as 'cleaver' profile). Because only a small part of the present blade (i.e. the notch) is designed for insuring non-interference between adjacent blades during pass-by, the rest of trailing edge can be shaped so as to optimize these other factors. Hence, in one embodiment, the blade of the present invention is shaped to have a large rounded ear design.

In a further aspect, a portion of the trailing edge not comprising the notch is rounded and convex.

In a further aspect, the propeller rotates about a propeller axis. A longest distance between the trailing edge and the leading edge when projected onto the propeller axis defines a width of the blade. Half of a difference between the diameter of the propeller and a diameter of the hub defines a height of the blade. In one embodiment, the blade of the present invention has a width longer than the height, similar to what is seen in conventional non variable pitch propellers. Having a blade with a high height, (and as a consequence a high propeller diameter) forces the gear case to be located lower under the water line. When the gear case is low, it generates a higher drag. Reducing drag is a critical factor in designing propellers. Moreover, at high rpm, such high-height-low-width blade type reduces the tip area necessary to control the water flow path, which generates cavitation. Furthermore, such design increases the tip area, which, at high rpm, helps to better control the water flow path.

Traditionally, blades for variable pitch propellers have the entirety of their base connected to the hub. If the base were to extend past the connecting portion to the hub, the base of that blade would interfere with an adjacent blade when the blades are pivoted. Blades of the present invention have a notch to prevent this interference. Thus in some embodiments, blades of the present invention do have portions extending past their connection to the hub. The presence of these portions between the connecting portion and the leading and trailing edges provides a more balanced blade design. In these embodiments, because the blade's design is more balanced one each side of its pitch axis, forces necessary to pivot the blade about its pitch axis are decreased in highly tip loaded conditions.

In a further aspect, the propeller rotates about a propeller axis. The propeller axis defines horizontal. The base has a portion connecting to the hub. The portion has a first end and a second end. A horizontal distance between the first end and the second end of the portion of the base is shorter than a horizontal distance between the leading end and the trailing end of the base.

In one embodiment, the blade profile is off-centered toward the leading edge. As a consequence, a portion of the base between the pivot point and the leading edge is longer than half of the width of the blade.

In an additional aspect, the propeller rotates about a propeller axis. The propeller axis defines horizontal. A longest horizontal distance between the trailing edge and the leading edge defines a width of the blade. The pitch axis intersects the base at a pivot point. A horizontal distance between the pivot point and the leading end of the base is longer than half of the width of the blade.

Water infiltration decreases the thrust produced by a blade. In one embodiment, the base is designed to minimize water infiltration between the hub and the blade. A portion of the base located between the leading end and the connecting portion is shaped to follow a curvature of the hub (as seen when the blades are at a maximum pitch angle to produce a forward thrust).

In an additional aspect, the base has a portion for connecting to the hub (connecting portion). The base has a leading portion extending between the connecting portion and the leading end. When the positive pitch angle is at a maximum angle for producing a forward thrust a curvature of the leading portion of the base follows at least partially a curvature of an external surface of the hub.

The shape and size of the notch goes in hand with the design of the leading edge. In some embodiments, the notch is located at the proximal end of the trailing edge to accommodate the proximal end of the leading edge.

In an additional aspect, the notch is located toward the proximal end of the trailing edge.

The notch represents only a small fraction of the blade's surface and of the trailing edge. One way to assess the size of the notch with respect to the blade or to the leading edge is by comparing a chord length between a most distal point of the notch and a most distal point of the trailing edge from the pivot point.

In an additional aspect, the distal end of the trailing edge connects the distal end of the leading edge at a juncture point. The notch has a distal end and a proximal end. The proximal end of the notch is the proximal end of the trailing edge. The pitch axis intersects the base at a pivot point. A length of a chord between the pivot point and the distal end of the notch is at most 80% of a length between the juncture point and the pivot point.

Another way to assess the size of the notch with respect to the blade or to the leading edge is by comparing the height of the trailing edge with the height of the notch.

In an additional aspect, the propeller rotates about a propeller axis. The propeller axis defines horizontal. The pitch axis defines vertical perpendicular to the horizontal. The pitch axis intersects the base at a pivot point. The distal end of the trailing edge connects the distal end of the leading edge at a juncture point. The notch has a distal end and a proximal end. The proximal end of the notch is the proximal end of the trailing edge. A vertical distance between the distal end of the notch and the pivot point is at most 60% of a vertical distance between the juncture point and the pivot point.

In some embodiments, the notch does not have a shape corresponding to a shape of a portion of the leading edge received in the notch during pass-by. Because the conventional blades do not have the notch, their trailing edge is shaped so as to correspond to the shape of the leading edge for preventing interference, and hence do not feature such a notch.

In an additional aspect, the notch of each of the plurality of blades has a shape dissimilar to a shape of a portion of the leading edge of the adjacent blade received in the notch during pivoting about their pitch axis.

In one embodiment, the notch is V-shaped.

In a further aspect, the notch of each of the plurality of blades has two generally straight portions forming a V.

In an additional aspect, the two generally straight portions form an angle of at least 65 degrees.

In a further aspect, the notch has rounded corners.

In a further aspect, each of the plurality of blades is skewed.

In an additional aspect, each of the plurality of blades has a rake angle.

In a further aspect, the trailing edge of each of the plurality of blades has a cup.

In an additional aspect, the variable pitch propeller has a progressive pitch.

In a further aspect, the variable pitch propeller has a pitch of about 24 inches per revolution when the positive pitch angle is at a maximum angle for producing a positive thrust.

In an additional aspect, the plurality of blades comprises between 3 and 5 blades.

In a further aspect, adjacent blades of the plurality of blades are separated by a clearance gap. The clearance gap prevents contact between at least a portion of the leading edges and the trailing edges of the adjacent blades.

In a further aspect, the variable pitch propeller further comprises an integral propeller shaft for operative connection with a drive shaft.

In an additional aspect, the variable pitch propeller further comprises a propeller shaft. At least a portion of the drive shaft is perpendicular to the propeller shaft.

In a further aspect, the hub comprises an exhaust outlet for fluid connection with the exhaust manifold of the engine for exhausting spent combustion components through the hub.

In one aspect, a propeller blade suitable for use on a variable pitch propeller on a marine internal combustion engine is provided. The propeller blade comprises a base having a leading end and a trailing end. A leading edge has a distal end and a proximal end. The proximal end of the leading edge connects the leading end of the base. A trailing edge has a distal end and a proximal end. The distal end of the trailing edge connects the distal end of the leading edge. The proximal end of the trailing edge connects the trailing end of the base. The trailing edge has a notch therein forming a discontinuity in a profile of the trailing edge. The notch is sized and shaped so as to accommodate passage therethrough of a portion of the leading edge of an adjacent blade of the propeller when the blade is attached to the propeller and when the blade and the adjacent blade are pivoted between a positive pitch angle and a negative pitch angle.

In an additional aspect, when in operation, a longest distance between the trailing edge and the leading edge when projected onto a propeller axis defines a width of the blade. Half of a difference between a diameter of the propeller and a diameter of the hub defines a height of the blade. The height of the blade is shorter than the width of the blade.

In a further aspect, when in operation the blade is mounted on the propeller. The propeller is adapted to rotate about a propeller axis. The propeller axis defines horizontal. The base has a portion adapted to connect to the hub. The portion has a first end and a second end. A horizontal distance between the first end and the second end of the portion of the base is shorter than a horizontal distance between the leading end and the trailing end of the base.

In an additional aspect, when in operation the blade is mounted on the propeller and pivots about a pitch axis. The propeller is adapted to rotate about a propeller axis. The propeller axis defines horizontal. A longest horizontal distance between the trailing edge and the leading edge defines a width of the blade. The pitch axis intersects the base at a pivot point. A horizontal distance between the pivot point and the leading end of the base is longer than half of the width of the blade.

In an additional aspect, the base is adapted to be mounted to the hub at a connecting portion. The connecting portion is disposed between the leading end and the trailing end of the base. A leading portion of the base between the connecting portion and the leading end has a curvature. When the blade is mounted on a hub of the propeller and when the blade is at a maximum pitch angle for producing a positive thrust, the curvature of the leading portion follows at least partially a curvature of an external surface of the hub.

In a further aspect, a portion of the trailing edge not comprising the notch is rounded and convex.

In an additional aspect, the notch is located toward the proximal end of the trailing edge.

In a further aspect, when in operation the blade is adapted to pivot about a pitch axis. The distal end of the trailing edge connects the distal end of the leading edge at a juncture point. The notch has a distal end and a proximal end. The proximal end of the notch is the proximal end of the trailing edge. The pitch axis intersects the base at a pivot point. A length of a chord between the pivot point and the distal end of the notch is at most 80% of a length between the juncture point and the pivot point.

In an additional aspect, when in operation the blade is mounted on the propeller and pivots about a pitch axis. The propeller is adapted to rotate about a propeller axis. The propeller axis defines horizontal. The pitch axis defines vertical perpendicular to the horizontal. The pitch axis intersects the base at a pivot point. The distal end of the trailing edge connects the distal end of the leading edge at a juncture point. The notch has a distal end and a proximal end. The proximal end of the notch is the proximal end of the trailing edge. A vertical distance between the distal end of the notch and the pivot point is at most 60% of a vertical distance between the juncture point and the pivot point.

In an additional aspect, the notch has a shape dissimilar to a shape of a portion of the leading edge of the adjacent blade received in the notch during pivoting about their pitch axis.

In a further aspect, the notch has two generally straight portions forming a V.

In an additional aspect, the two generally straight portions form an angle of at least 65 degrees.

In a further aspect, the notch has rounded corners.

In yet another aspect, a propeller blade suitable for use on a variable pitch propeller on a marine internal combustion engine is provided. The propeller blade comprises a face, a back opposite to the face, and a base. The base is adapted to connect at least partially to the variable pitch propeller. Three apertures for connecting the blade to the propeller are located near the base. The three apertures are positioned on only one of the face and the back.

In an additional aspect, the three apertures are adapted to each receive a fastener for securing the blade to the variable pitch propeller.

In a further aspect, each of the three apertures is adapted to receive therein a head of a corresponding fastener.

In an additional aspect, the three apertures are disposed in a triangular pattern.

In a further aspect, wherein one of the three apertures is disposed nearer to the base than the other two of the three apertures.

In an additional aspect, the three apertures are disposed on the back of the blade.

In another aspect, a variable pitch propeller suitable for use in association with a marine internal combustion engine is provided. The propeller comprises a hub, and a plurality of blades. Each of the plurality of blades is pivotally connected to the hub so as to pivot about a pitch axis at a pitch angle. Each of the plurality of blades has a face and a back. The propeller also comprises a plurality of cam follower assemblies. Each of the plurality of blades has an associated unique cam follower assembly. Each cam follower assembly is pivoting its associated blade about its pitch axis to vary the pitch angle of the blade. Each cam follower assembly including a cam follower. Each blade and its associated cam follower assembly is arranged such that at least one plane containing the pitch axis passes between the cam follower and the face of the blade.

In the present application, terms related to spatial orientation such as forwardly, rearwardly, left, and right, should be interpreted are as they would normally be understood by a driver of a watercraft sitting thereon in a normal driving position, when the engine is mounted to the stern of the watercraft. When these terms are used in relation to a propeller alone, they should be interpreted as they would be understood if the propeller were installed on a watercraft.

For the purposes of this application, the term 'blade face' refers to the positive pressure side of the blade. When the blade is mounted on the variable pitch propeller and the variable pitch propeller is mounted on the boat, the blade face is the side of the blade that faces away from the boat. The term 'blade back' refers to the negative pressure (suction) side of the blade. When the blade is mounted on the variable pitch propeller and the variable pitch propeller is mounted on the boat, the blade back is the side of the blade that faces the boat. The term 'propeller' in the present specification includes all types of water-contacting rotors used to propeller a boat, such as the impeller of water jet drive engine. The term 'diameter' refers to the distance across the circle made by the blade tips mounted on the hub, as the propeller rotates. The term 'blade tip' refers to the part of the blade most remote from the center of the hub. The term 'pitch' refers to the distance that the propeller would move in one revolution if it were moving though a soft solid. The term 'positive pitch' refers to a distance in the forward direction. The term 'negative pitch' refers to a distance in the rearward direction. The term 'pitch angle' refers to an angle at which the blade is pivoted such as to produce a specific thrust. The term 'positive pitch angle' refers to an angle at which the blade is pivoted such as to produce a forward thrust (positive pitch). The term 'negative pitch angle' refers to an angle at which the blade is pivoted such as to produce a rearward thrust (negative thrust). The term 'chord' refers to a straight line joining the two extremities of an arc of circle or a curve. The term 'profile' refers to the shape (or contour) of the an element (blade, trailing edge etc.) as viewed directly in front of the blade face or back. The term 'width' refers to a distance between two points projected on the rotation axis of the propeller. The term 'height' refers to a distance between two points projected on a vertical axis perpendicular to the rotation axis of the propeller (pivot axis). The term 'skew' refers to a blade having a sweep back, i.e. a blade that does not have a radially symmetrical contour or profile. The term 'rake' refers to the angle between the face of the blade and the propeller axis as seen from a cut extending directly through the center of the hub. The term 'cup' refers to a small curved lip at the blade tip or at the trailing edge of the blade. The term 'notch' refers to a small indentation, nick or cut in an edge, a contour, a profile or a surface. The term 'discontinuity' refers to a lack of logical continuation or cohesion of two connected elements. The term 'pass-by' refers to two adjacent blades being at pitch angles such that a portion of the leading edge of one of the blade is contained in a zone left by the trailing edge of the other blade for passing by during rotation of the blades about their pitch axis. The term 'chord at the hub' refers to a chord between extremities of the base.

The present invention has at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

Figure 1:
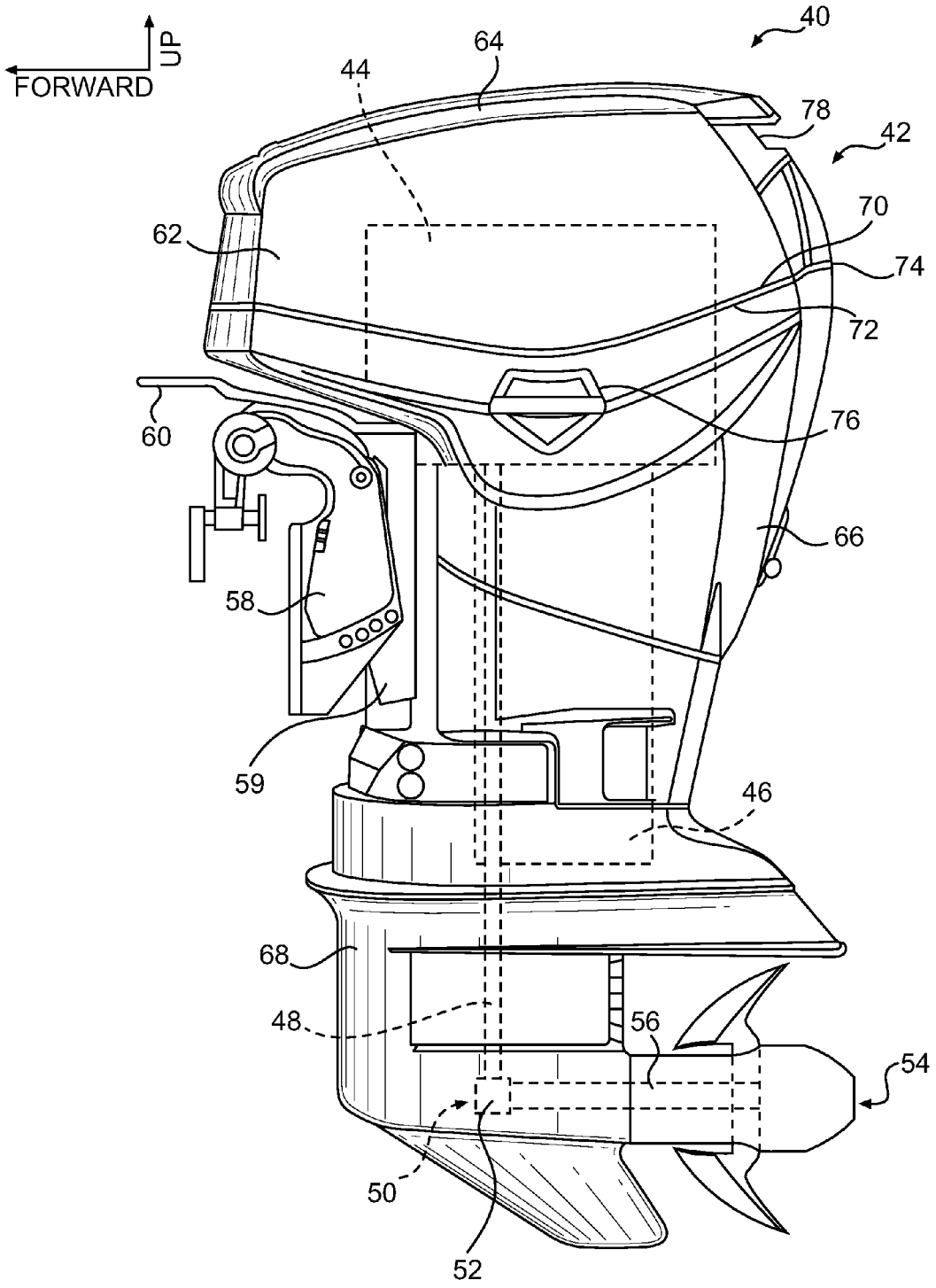
FIG. 1 is a side elevation view of a marine outboard engine having a variable pitch propeller being an embodiment of the present invention.

Referring to FIG. 1, a marine outboard engine 40 having a variable pitch propeller assembly 54 with blades 300 being an embodiment of the present invention will be described. It should be understood that embodiments of the present invention may also be applied to other marine applications having internal combustion engines and propellers, such as inboard engines, surface drive engines, water jet drive engines, and stern drive engines.

FIG. 1 is a side view of a marine outboard engine 40 having a cowling 42. The cowling 42 surrounds and protects an engine 44, shown schematically. The engine 44 may be any suitable engine known in the art, such a 2-stroke or a 4-stroke internal combustion engine. An exhaust system 46, shown schematically, is connected to the engine 44 and is also surrounded by the cowling 42.

The engine 44 is coupled to a vertically oriented driveshaft 48. The driveshaft 48 is coupled to a drive mechanism 50, which includes a transmission 52 and the variable pitch propeller assembly 54 (shown schematically) mounted on a propeller shaft 56. The propeller shaft 56 is generally perpendicular to the driveshaft 48. It is contemplated that the propeller shaft 56 could not be perpendicular to the driveshaft 48. The propeller shaft 56 defines a rotation axis 206 (shown in FIG. 2). The drive mechanism 50, the variable pitch propeller assembly 54 and the propeller shaft 56 will be described below in further detail. Other known components of an engine assembly are included within the cowling 42, such as a starter motor and an alternator. As it is believed and understood that these components would be readily recognized by one of ordinary skill in the art, and thus further explanation and description of these components will not be provided herein.

A stern bracket 58 is connected to the cowling 42 via the swivel bracket 59 for mounting the outboard engine 40 on a watercraft. The stern bracket 58 can take various forms, the details of which are conventionally known.

A linkage 60 is operatively connected to the cowling 42, to allow steering of the outboard engine 40 when coupled to a steering mechanism of a boat, such as a steering wheel.

The cowling 42 includes several primary components, including an upper motor cover 62 with a top cap 64, and a lower motor cover 66. A lowermost portion, commonly called the gear case 68, is attached to the exhaust system 46. The upper motor cover 62 preferably encloses the top portion of the engine 44. The lower motor cover 66 surrounds the remainder of the engine 44 and the exhaust system 46. The gear case 68 encloses the transmission 52 and supports the drive mechanism 50, which will be described below in further detail.

The upper motor cover 62 and the lower motor cover 66 are made of sheet material, preferably plastic, but could also be metal, composite or the like. The lower motor cover 66 and/or other components of the cowling 42 can be formed as a single piece or as several pieces. For example, the lower motor cover 66 can be formed as two lateral pieces that mate along a vertical joint. The lower motor cover 66, which is also made of sheet material, is preferably made of composite, but could also be plastic or metal. One suitable composite is fiberglass.

A lower edge 70 of the upper motor cover 62 mates in a sealing relationship with an upper edge 72 of the lower motor cover 66. A seal 74 is disposed between the lower edge 70 of the upper motor cover 62 and the upper edge 72 of the lower motor cover 66 to form a watertight connection.

A locking mechanism 76 is provided on at least one of the sides of the cowling 42. Preferably, locking mechanisms 76 are provided on each side of the cowling 42.

The upper motor cover 62 is formed with two parts, but could also be a single cover. As seen in FIG. 1, the upper motor cover 62 includes an air intake portion 78 formed as a recessed portion on the rear of the cowling 42. The air intake portion 78 is configured to prevent water from entering the interior of the cowling 42 and reaching the engine 44. Such a configuration can include a tortuous path. The top cap 64 fits over the upper motor cover 62 in a sealing relationship and preferably defines a portion of the air intake portion 78. Alternatively, the air intake portion 78 can be wholly formed in the upper motor cover 62 or even the lower motor cover 66.

Figure 2:
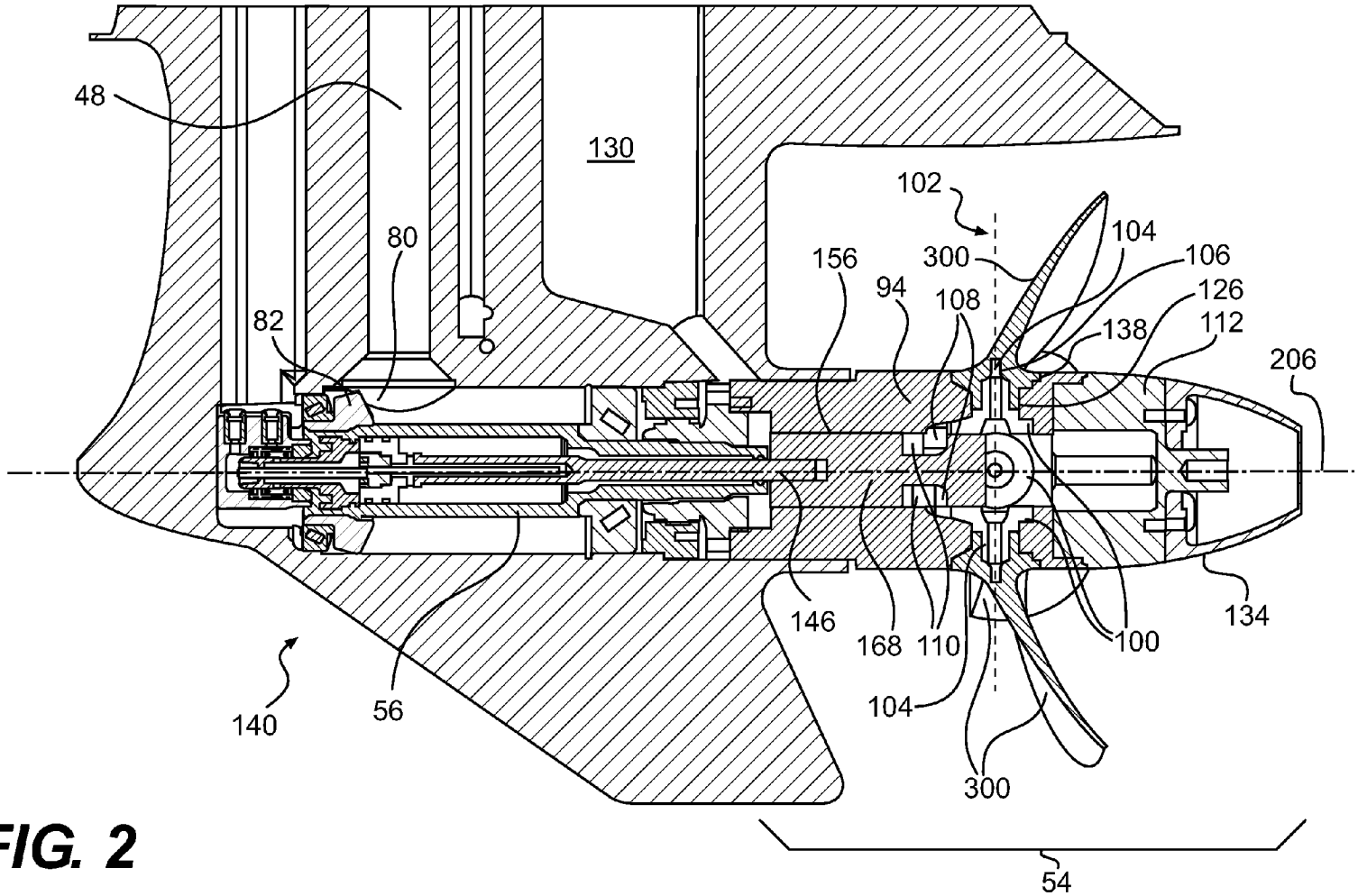
FIG. 2 is a cross-sectional view of the gear case of the outboard engine of FIG. 1.

Referring to FIG. 2, the drive mechanism 50 will now be described.

A bevel gear 80 is mounted on one end of the driveshaft 48. The bevel gear 80 meshes with the bevel gear 82 that is mounted to the propeller shaft 56. The driveshaft 48 drives the propeller shaft 56 to propel a watercraft (not shown) in either the forward direction or the reverse direction, depending on the pitch angle of the blades 300, as will be described below in further detail. An optional transmission assembly (not shown) is capable of disengaging the engine 44 from the bevel gear 82, resulting in a neutral state wherein the propeller shaft 56 is not driven and the watercraft is no longer propelled in a body of water. A neutral state may alternatively be achieved by varying the pitch angle of the blades 300, as will be discussed below in further detail.

Referring to FIG. 2, the variable pitch propeller assembly 54 being an embodiment of the present invention will now be described.

The variable pitch propeller assembly 54 includes four propeller blades 300 disposed at 90 degrees from each other. The blades 300 are received in recesses 126 formed in the hub 94. It is contemplated that in other embodiments the variable pitch propeller assembly 54 could comprise a different number of blades 300. In this embodiment, the blades 300 are made of stainless steel. It is contemplated that in other embodiments the blades 300 could be made of another material, such as another metal or an alloy. Sealing rings 138 provide a water-tight seal between the hub 94 and the blades 300.

Each blade 300 has a corresponding cam follower assembly 100. A D-shaped or otherwise non-circular end 104 of the cam follower assembly 100 is received in a complementarily-shaped aperture 106 in the corresponding blade 300, such that rotating the cam follower assembly 100 causes the blade 300 to pivot about a pitch axis 102 to vary the pitch angle of the blade 300. In this embodiment, each pair of blades 300 on opposite sides of the hub 94 has coaxial pitch axis 102. It is contemplated that the blade 300 may be connected to the cam follower assembly 100 by any other suitable connection, such as a spline connection. It is further contemplated that in other embodiments the cam follower assembly 100 may be formed integrally with the blade 300 in a one piece construction. Each cam follower assembly 100 has a cam follower 108 that is received in a corresponding recess 110 in the cam 168. The cam follower assemblies 100 are rotated by the cam 168 in a manner that will be described in further detail below. It should be understood that in other embodiments more or fewer than four propeller blades 300 may be used, in which case the cam 168 would have a recess 110 corresponding to each propeller blade 300. The propeller blades 300 will be described in greater details below.

A spacer 112 is bolted to the rear portion of the hub 94, to allow an increased range of motion for the cam 168, as will be described in further detail below. A cap 134 is received in the rear portion of the spacer 112. The cap 134 improves the aesthetic and hydrodynamic properties of the variable pitch propeller assembly 54, and provides a path for exhaust from the exhaust chamber 130 to exit (in a known manner) via channels (not shown) in the hub 94, and spacer 112.

Figure 3:
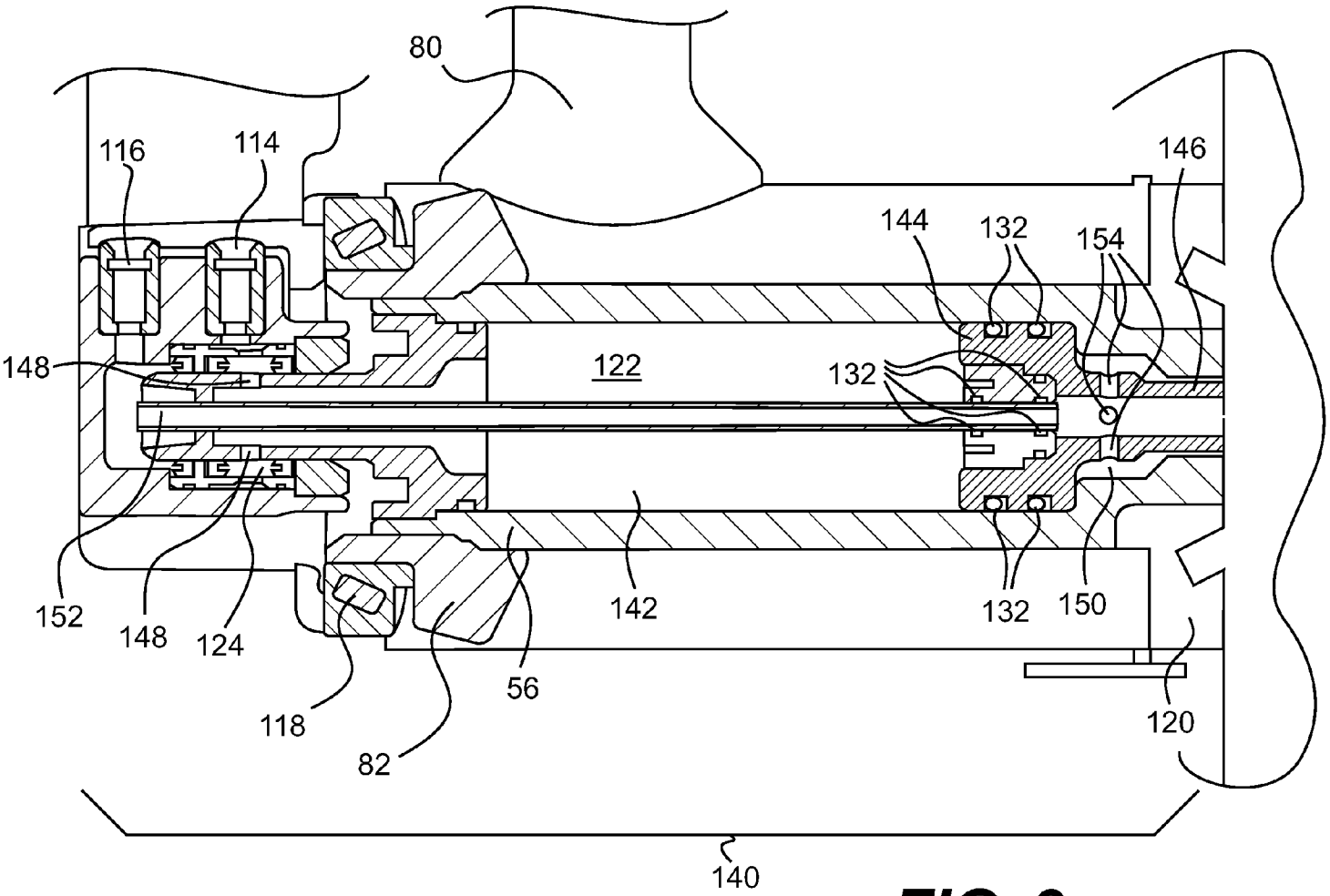
FIG. 3 is a close-up view of the gear case of FIG. 2, showing the piston in a different position.

Referring now to FIG. 3, a variable pitch system for varying the pitch angle of the blades 300 of the variable pitch propeller assembly 54 will now be described.

The variable pitch system is operated by an actuator 140 in the form of a linear hydraulic actuator. The actuator 140 includes a housing 142 formed inside the propeller shaft 56, a piston 144 that can reciprocate within the housing 142, a shaft 146 fixed to the piston 144, and a cam 168 (FIG. 2) fixed to the rearward end of the shaft 146. The actuator 140 is coupled to a set of hydraulic valves 114 and 116, and is supported by tapered bearings 118 and 120. The hydraulic valves 114, 116 are preferably controlled by an electronic control unit (ECU, not shown) to ensure precise operation of the actuator 140. The hydraulic valve 114 permits hydraulic fluid to enter the chamber 122 via the annular channel 124 and the apertures 148, to urge the piston 144 rearwardly toward the position shown in FIG. 3. The hydraulic valve 116 permits hydraulic fluid to enter the chamber 150 via the hydraulic line 152 and the apertures 154, to urge the piston 144 forwardly toward the position shown in FIG. 2. It should be understood that the valves 114, 116 could be placed at any suitable location. It is contemplated that in other embodiments a valveless hydraulic actuator could alternatively be used, for example by replacing the valves 114, 116 with connections to a reversible hydraulic motor. Operation of the reversible hydraulic motor in one direction would cause fluid to enter the chamber 122, and operation of the reversible hydraulic motor in the reverse direction would cause fluid to enter the chamber 150. Sealing rings 132 provide a seal between the piston 144, the chamber 122 and the hydraulic line 152. The reciprocating movement of the piston 144 drives the shaft 146, which extends through an end of the housing 142 to the hub 94 to drive the cam 168. The hub 94 and spacer 112 together form a channel 156 (FIG. 2) in which the cam 168 reciprocates. It is contemplated that any other suitable type of actuator 140 may alternatively be used.

Figure 4:
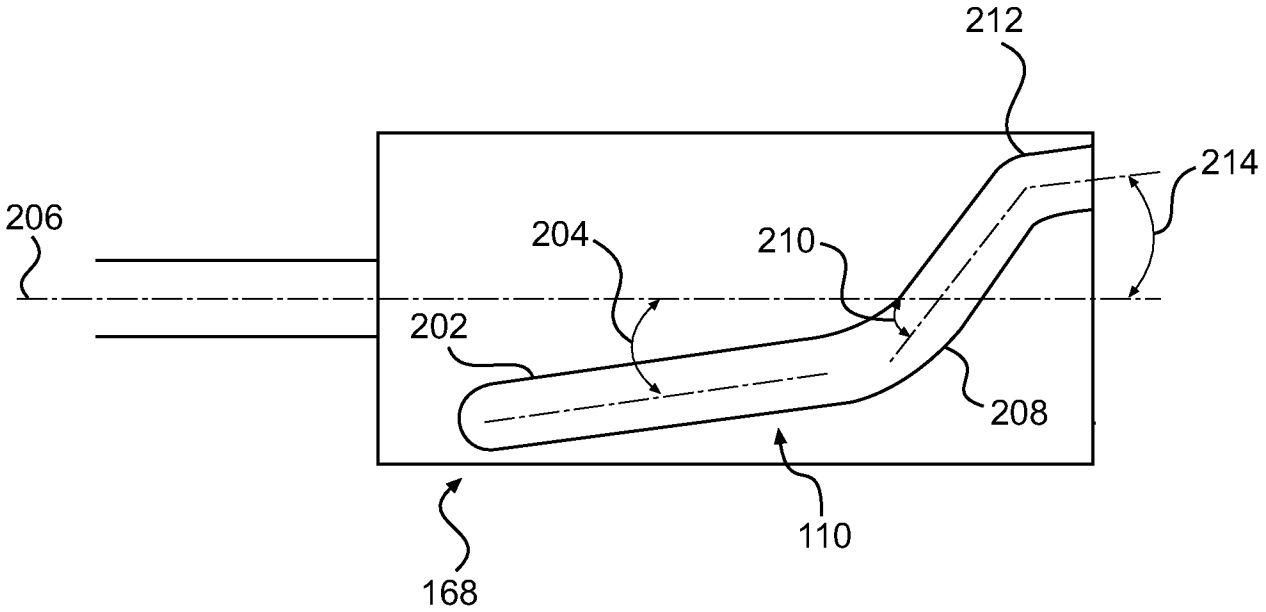
FIG. 4 is a plan view of a cam of a variable pitch propeller assembly being the embodiment of the present invention.

Referring now to FIG. 4, the cam 168 has four recesses 110 formed therein, corresponding to the four blades 300 (only one recess 110 is actually shown in FIG. 4). A first segment 202 of the recess 110 is oriented at a first angle 204 relative to the rotation axis 206 of the propeller shaft 56. A second segment 208 of the recess 110, disposed rearwardly of the first segment 202, is oriented at a second angle 210 relative to the rotation axis 206 of the propeller shaft 56. A third segment 212 of the recess 110, disposed rearwardly of the second segment 208, is oriented at a third angle 214 relative to the rotation axis 206 of the propeller shaft 56. The second angle 210 is greater than each of the first angle 204 and the third angle 214. Each cam follower 108 is received in, and engages, a corresponding recess 110. The cam follower 108 has a round pin (not shown) to fit the recess 110 shown in FIG. 4. The cam follower 108 shown in FIG. 6E appears to have an oval profile due to the fact that a separate piece has been fitted to the round pin. It is contemplated that the cam follower 108 could not have a rounded profile, and could not have a separate piece fitted to the round pin to form a generally oval cam follower. It should be understood that in other embodiments a variable pitch propeller assembly 54 having more or fewer than four blades 300 would have a cam 168 with a corresponding number of recesses 110. For example, in some embodiments, the variable pitch propeller assembly 54 may have three blades 300 evenly spaced around the hub 94, and a three-sided cam 168 having three corresponding recesses 110.

Figure 5A:
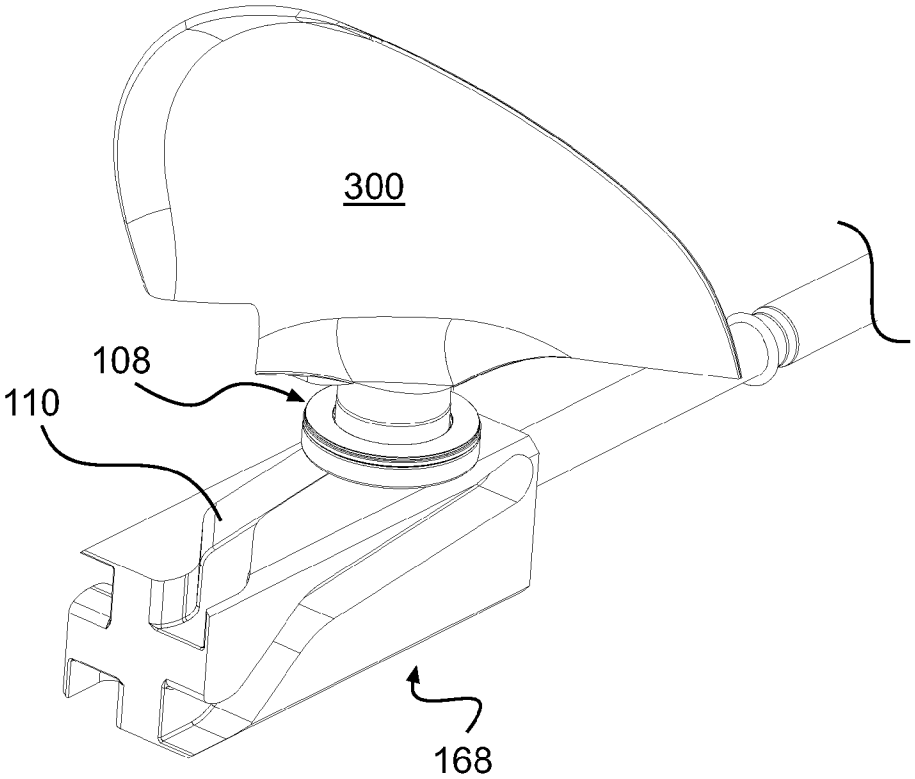
FIG. 5A is a right, rear perspective view of the variable pitch propeller assembly of FIG. 4 showing the cam in a first position.
Figure 5B:
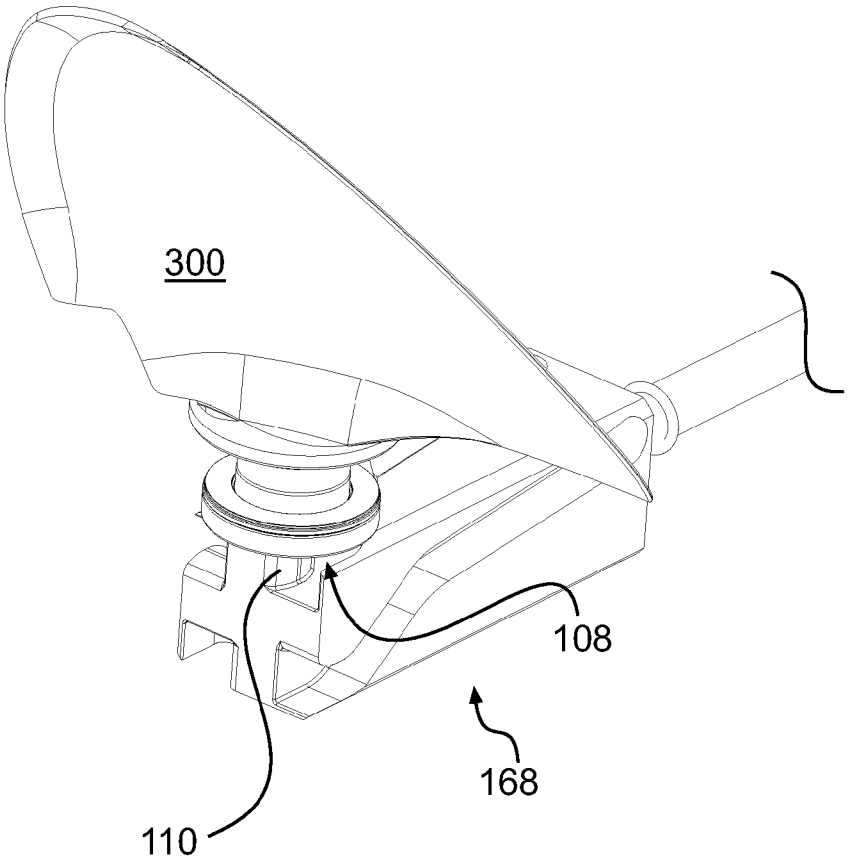
FIG. 5B is a right, rear perspective view of the variable pitch propeller assembly of FIG. 4 showing the cam in a second position.
Figure 5C:
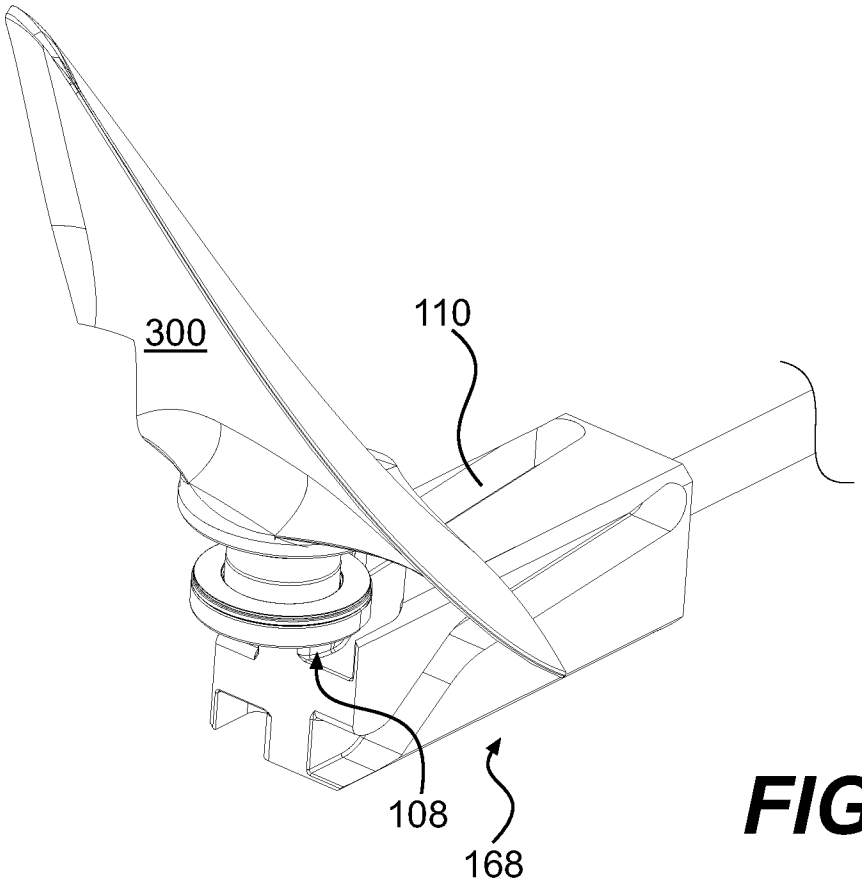
FIG. 5C is a right, rear perspective view of the variable pitch propeller assembly of FIG. 4 showing the cam in a third position.

Referring to FIGS. 5A, 5B and 5C, as the cam 168 reciprocates within the channel 156 (shown in FIG. 2), the portion of the recess 110 in contact with the corresponding cam follower 108 causes the cam follower 108 to rotate and thereby vary the pitch angle of the corresponding blade 300. When the cam 168 is forwardly of a first position at the first angle 204 (shown in FIG. 4, a corresponding position of the blade 300 being shown in FIG. 5A) and rearwardly of a second position at the second angle 210 (shown in FIG. 4, a corresponding position of the blade 300 being shown in FIG. 5B), the cam follower 108 engages the first segment 202 of the cam 168. The relatively shallow first angle 204 (of the recess 110) causes the pitch angle of the blade 300 to vary relatively slowly as the cam 168 moves between the first position and the second position. This permits fine adjustments of the pitch angle of the blades 300, to achieve the desired performance characteristics while propelling the watercraft in the forward direction. It is contemplated that in other embodiments the first angle 204 would be chosen such as to accelerate the cam 168 between the first and the second positions.

When the cam 168 is forwardly of the second position and rearwardly of a third position the third angle 214 (shown in FIG. 4, a corresponding position of the blade 300 being shown in FIG. 5C), the cam follower 108 engages the second segment 208 of the cam 168. The relatively steep second angle 210 causes the pitch angle of the blade 300 to vary relatively quickly as the cam 168 moves between the second position and the third position. The pitch angle of the blade 300 varies at a second rate that is preferably greater than the first rate. This permits rapid shifting of the pitch angle of the blades 300 between the second position, in which the watercraft is propelled in the forward direction, and the third position, in which the watercraft is propelled in the reverse direction. In this manner, the watercraft can quickly and conveniently be propelled in the reverse direction by varying the pitch angle of the blades 300 without changing the direction of rotation of the variable pitch propeller assembly 54. The increased rate of pitch angle change between the second and third positions reduces the degree of travel of the cam 168, allowing for a more compact arrangement. It is contemplated that in other embodiments the watercraft would also be propelled in the forward direction when the cam 168 is in the third position. It is further contemplated that the rate of pitch angle change could be constant or decreased between the second and the third positions.

It should be understood that there exists a pitch angle of the blades 300 corresponding to a zero thrust point, at which the rotation of the variable pitch propeller assembly 54 provides no thrust in either of the forward or reverse directions. The zero thrust point occurs between the pitch angle range in which the watercraft is propelled in the forward direction and the pitch angle range in which the watercraft is propelled in the reverse direction, when the cam 168 is between the second position and the third position. A neutral state may therefore be achieved by setting the pitch angle of the blades 300 to the zero thrust pitch angle, without turning off the engine 44 or disengaging the engine 44 from the variable pitch propeller assembly 54.

When the cam 168 is positioned forwardly of the third position, the cam follower 108 engages the third segment 212 of the cam 168. In this position, the rotation of the variable pitch propeller assembly 54 propels the watercraft in the reverse direction, and the pitch angle of the blades 300 varies at a third rate that is less than the second rate. The third segment 212 extends to the end 216 of the cam 168, to allow the variable pitch propeller assembly 54 to be assembled by sliding the cam followers 108 through the end 216 of the cam 168 into their respective recesses 110. The third angle 214 is preferably parallel to the propeller shaft 56, to allow for simple assembly, in which case the third rate is zero.

Referring now to FIGS. 6A-6E, the blade 300 will be described in greater details. Throughout the figures, the blade 300 will have dimension described using the word 'width' for designating horizontal distances, and the word 'height' for designating vertical distances. Horizontal is defined by the rotation axis 206 of the propeller shaft 56. Vertical is defined by the pivot axis 102, which is perpendicular to the rotation axis 206.

Figure 6A:
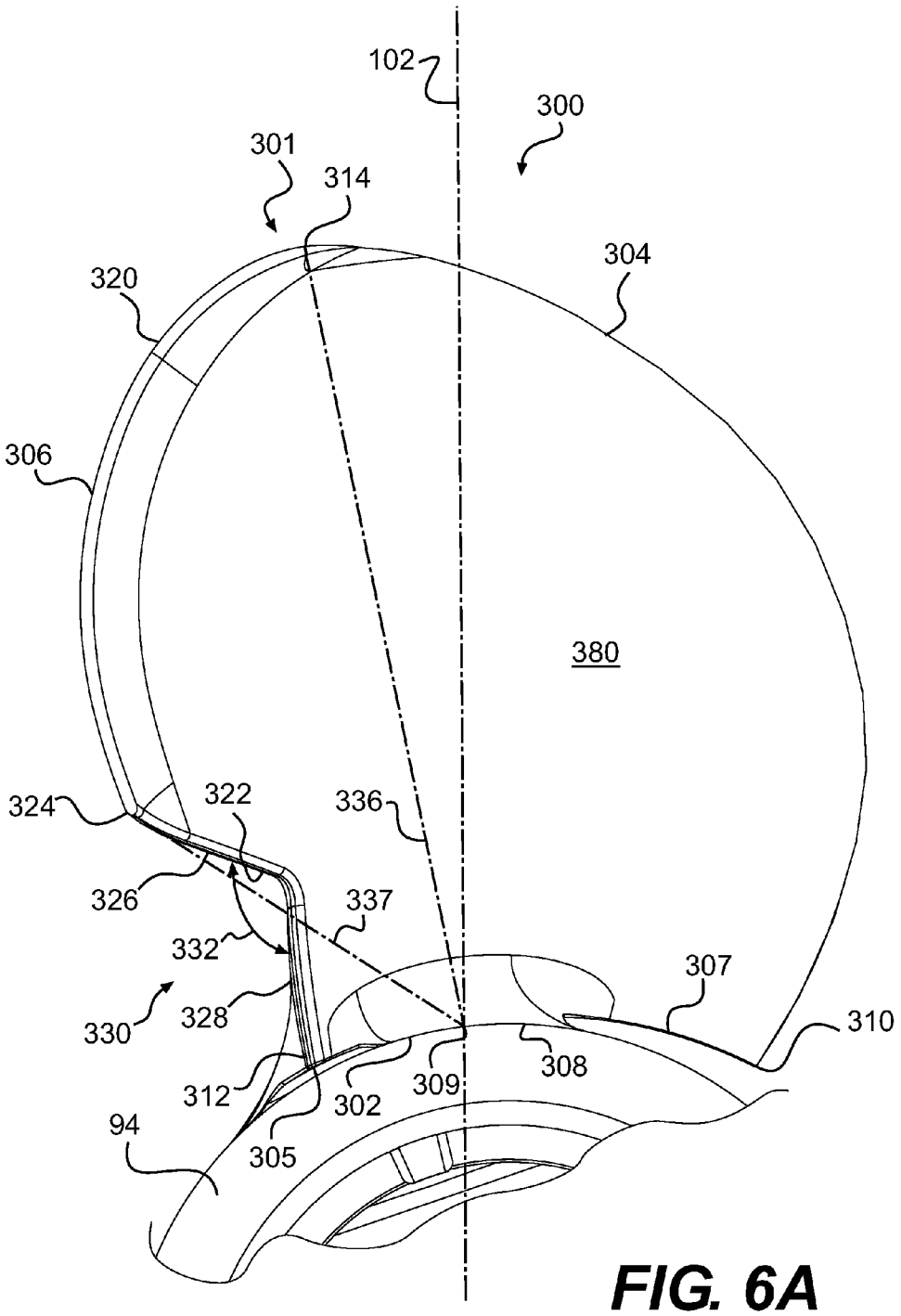
FIG. 6A is a rear, right perspective view of a blade according to an embodiment of the present invention.
Figure 6B:
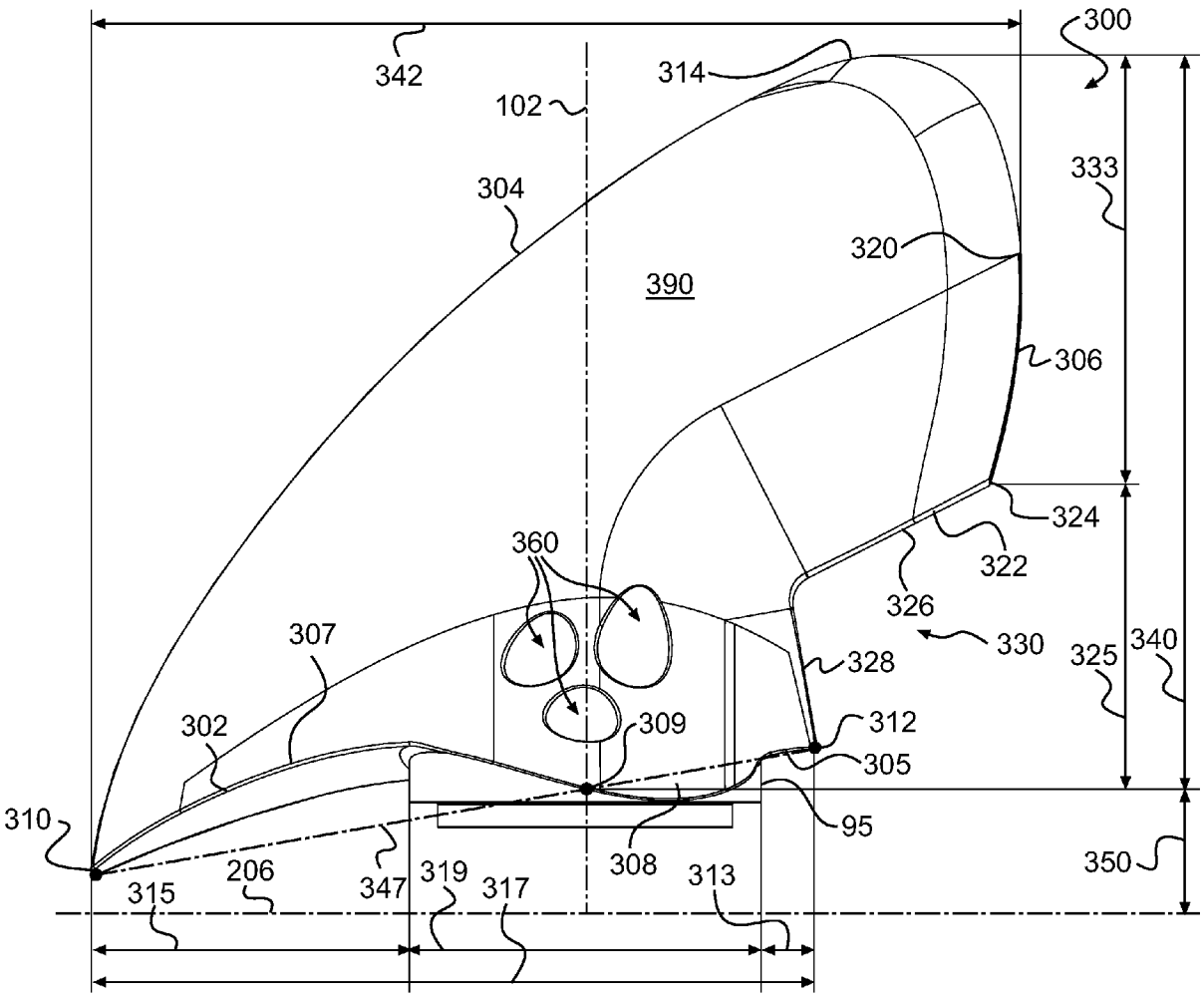
FIG. 6B is a front, left perspective view of the blade of FIG. 6A.

The blades 300 each have a face 380 (shown in FIG. 6A) and a back 390 (shown in FIG. 6B). As best seen in FIG. 6B, the blades 300 each have three apertures 360 which receive bolts 361 (shown in FIG. 6C) for connecting to the hub 94 via a connector 95 (shown in FIG. 6B). It is contemplated that the three apertures 360 could receive fasteners other than the bolts 361. The three apertures 300 are disposed in a triangular pattern. One of the three apertures 360 is proximate to the hub 94, while two of the three apertures 360 are more distal from the hub 94. The three apertures 360 are disposed on the back 390 of the blade 300. The bolts 361 are easily accessible from the apertures 360. A user desiring to replace a blade 300 unscrews the bolts 361 to detach the blade 300 from the hub 94 without having to remove the whole variable pitch propeller assembly 54. It is contemplated that the blades 300 could be attached to the hub 94 by means other than with bolts. It is also contemplated that the blades 300 could have less or more than three apertures 360 to connect to the hub 94. It is also contemplated that the apertures 360 could be disposed in a fashion other than in a triangle, and that two apertures 361 could be disposed proximate to the hub 94. It is contemplated that the apertures 361 could be disposed on the face 380 of the blade 300, and that the apertures 361 could not all be disposed on a same side (face 380 or back 390) of the blade 300.

Figure 6C:
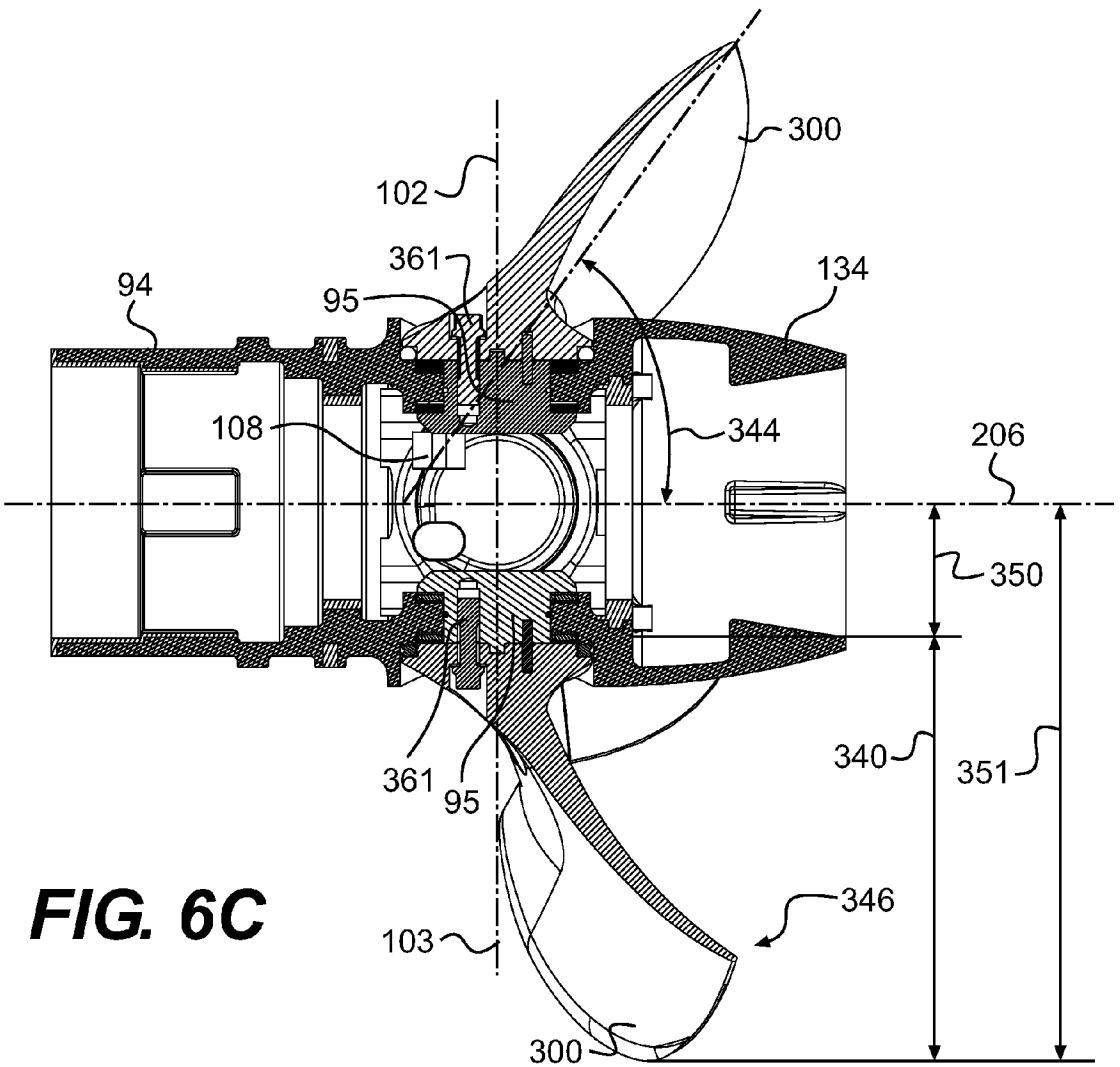
FIG. 6C is a longitudinal cross-sectional view of the propeller assembly with elements removed for clarity.
Figure 6D:
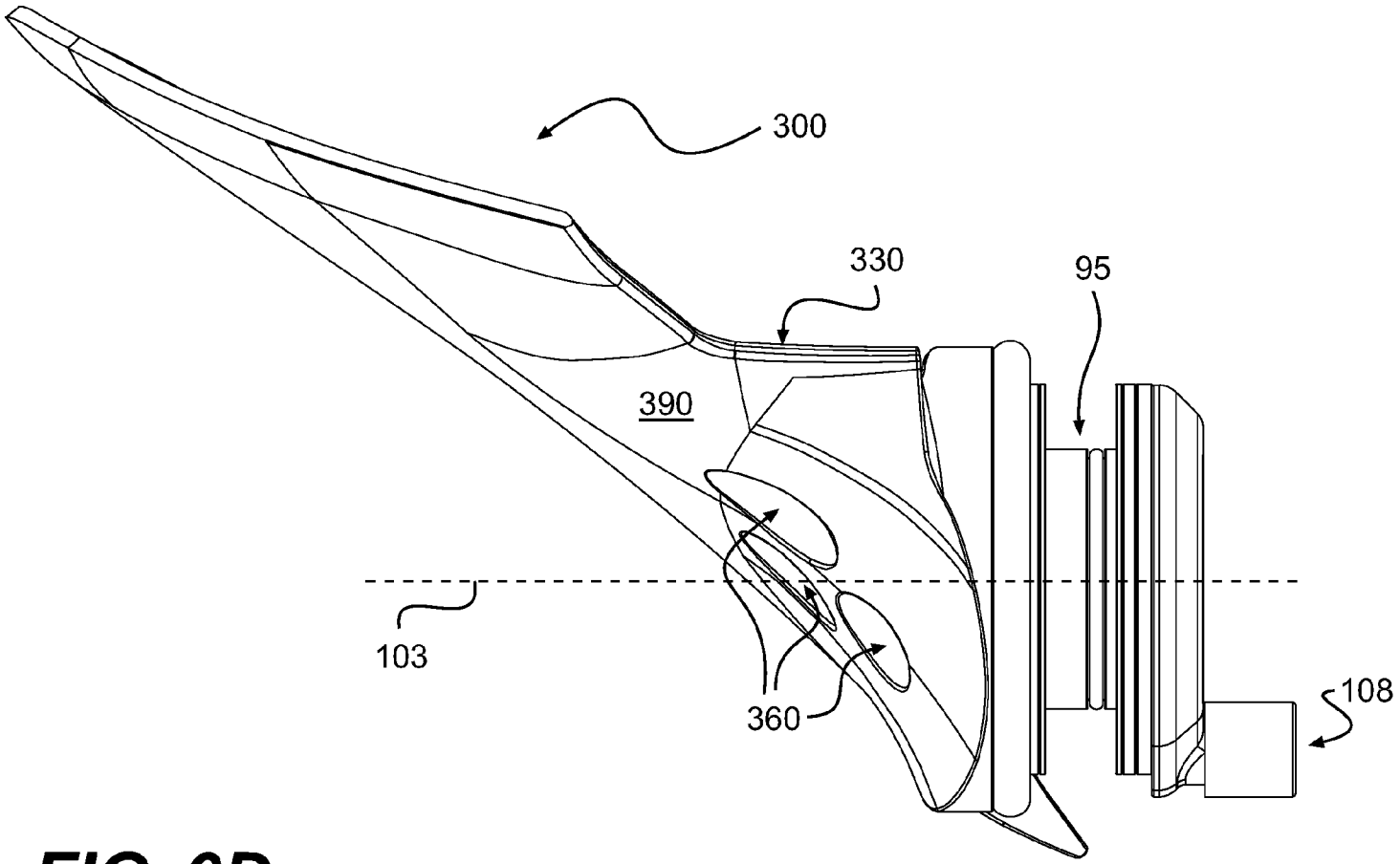
FIG. 6D is a side elevation view of the blade of FIG. 6A shown with a portion of the variable pitch propeller assembly of FIG. 4.
Figure 6E:
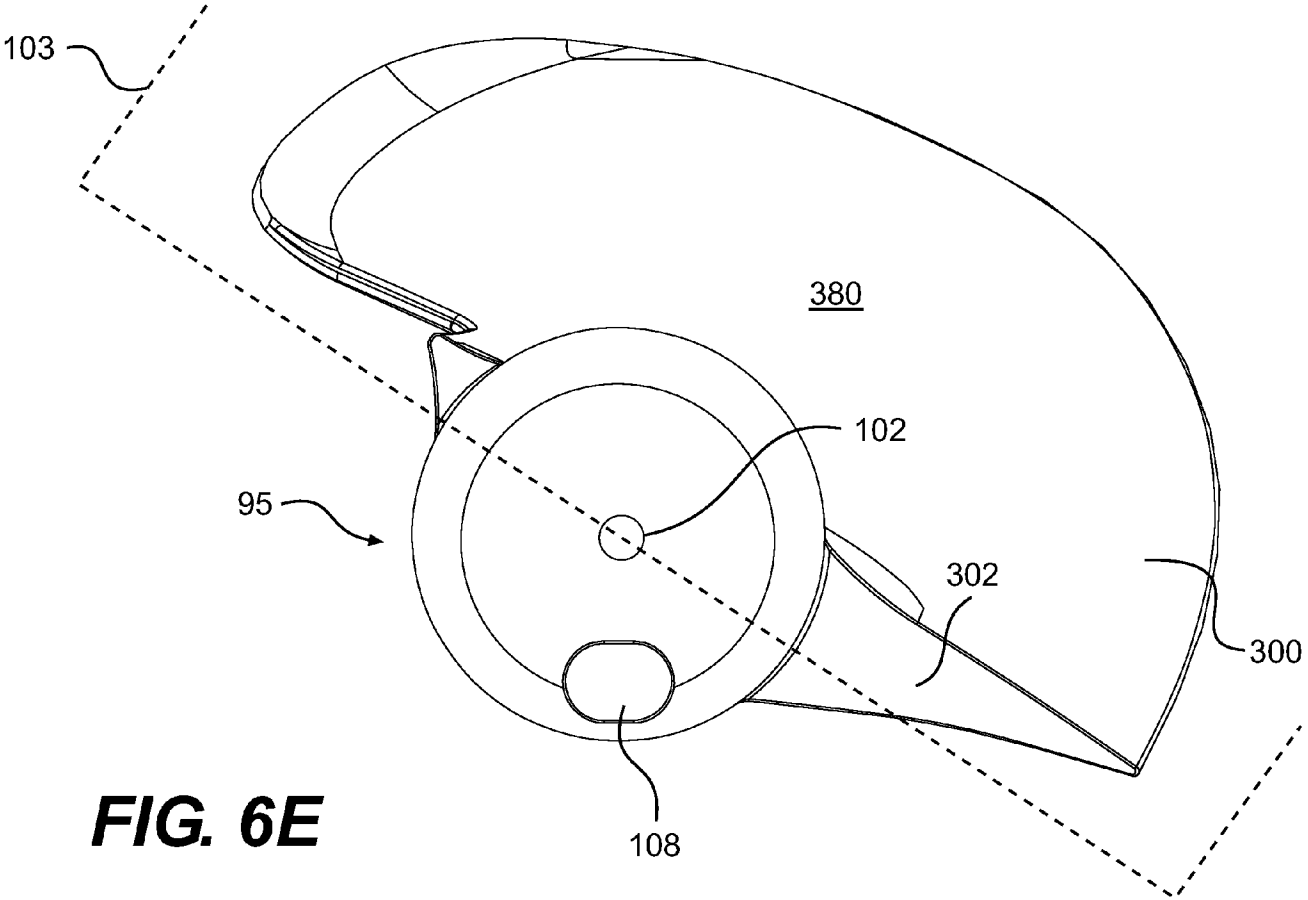
FIG. 6E is a bottom view of the blade shown with a portion of the variable pitch propeller assembly of FIG. 6D.

As best seen in FIGS. 6D and 6E, a plane 103 containing the pitch axis 102 passes between the face 380 of the blade 300 and the cam follower 108. As the cam follower 108 moves, the plane 103 rotates as the blade 300 rotates, and the face 380 of the blade 300 stays on one side of the plane 103 and the cam follower 108 stays on the other side of the plane 103. It is contemplated that, in certain embodiments, the plane 103 could be disposed between the cam follower 108 and only a portion of the face 380 of the blade 300. It is also contemplated that, in other embodiments, there may not be such plane 103.

The blade 300 has a base 302 proximate to the hub 94, a leading edge 304, and a trailing edge 306. The base 302 has a leading end 310 connected to the leading edge 304 and a trailing end 312 connected to the trailing edge 306. The base 302 has a curved profile that follows a curvature of the hub 94 (as viewed when the blade 300 is mounted on the hub 94 and is at a maximum pitch angle for producing a forward thrust). It is contemplated that in other embodiments the base 302 would not have a curved profile that follows the curvature of the hub 94.

The base 302 has a portion 308, located between the leading end 310 and the trailing end 312, for connecting the blade 300 to the connector 95 to the hub 94. The portion 308 has a midpoint 309, which is a pivot point 309 of the blade 300. The pivot point 309 is at the intersection between the pitch axis 102 and the base 302. The base 302 is longer than the portion 308. In this embodiment, a width 317 of the base 302 is 5.21 inches and a width 319 of the portion 208 is 2.5 inches. In another embodiment, the width 317 is 6.32 inches and the width 319 is 3.31 inches. A portion 307 of the base 302 extends from the portion 308 to the leading end 310, and a portion 305 of the base 302 extends from the portion 308 to the trailing end 312. A width 315 of the portion 307 of is longer than a width 313 of the portion 305. In this embodiment, the width 315 is about 2.31 inches, and the width 313 is about 0.4 inches. In another embodiment, the width 315 is about 3.02 inches, and the width 313 is about 0.75 inches. The presence of the portions 305, 307 provides balance to the blade 300 design by decreasing the rotational forces necessary to pivot the blade 300 about its pitch axis 102 in highly tip 301 loaded conditions. It is contemplated that the portions 305, 307 could be of a same length or than the portion 305 could be longer than the portion 307.

The leading edge 304 and the trailing edge 306 extend from the base 302 away from the hub 94. In this embodiment, the leading edge 304 has a proximal end being the leading end 310 of the base 302, and a distal end being the trailing edge 306. It is contemplated that in other embodiments the proximal end of the leading edge 304 could be different from the leading end 310 of the base 302, and the distal end of the leading edge 304 could be different from the trailing edge 306. The trailing edge 306 has a proximal end connected to the leading end 310 of the base 302, and a distal end connected to the leading edge 304. The distal ends of the leading edge 304 and the trailing edge 306 connect at the juncture point 314.

The leading edge 304 has a rounded convex profile that forms a sharp edge with the base 302 at the leading end 310 of the base 302. It is contemplated that in other embodiments the leading edge 304 could have a blunt edge with the base 302. The leading edge 304 connects the trailing edge 306 bluntly, such that the juncture point 314 does not form a discontinuity between the leading edge 304 and the trailing edge 306.

The trailing edge 306 has a first portion 320 towards the leading edge 304, and a second portion 322 towards the base 302. The first portion 320 and the second portion 322 connect at point 324. The first portion 320 forms most of the trailing edge 306, while the second portion 322 defines a discontinuity in the trailing edge 306 profile, as it will be described in greater details below.

The first portion 320 is a rounded and convex, and partially delimits a large rounded tip 301 of the blade 300. By having the large rounded shape of first portion 320, water pressure is allowed to distribute on the tip's 301 surface area in order to control flow of water at the tip 301. It is contemplated that in other embodiments the first portion 320 would not be designed based on the above criteria. It is also contemplated that in other embodiments the first portion 320 would have a shape different from a rounded convex shape.

The first portion 320 represents a majority of the trailing edge 306. There are several ways to assess the size of the first portion 320 with respect to the size of the trailing edge 306. As best seen in FIG. 6A, one way to assess the size of the first portion 320 is by comparing chord lengths with respect to the pivot point 309. The length of a chord 336 between the distal end of the first portion 320 (i.e. juncture point 314) and the pivot point 309 is computed with respect to the length of a chord 337 between the distal end of the first portion 320 (i.e. point 324) and the pivot point 309. In this embodiment, the length of the chord 337 of the first portion 320 is about 45% of the length of the chord 336. Hence the first portion 320 represents 65% of the trailing edge 306. In other embodiments the first portion 320 represents 30%, 42%, 54%, 66%, 75%, 70%, or any number in between of the trailing edge 306.

As best seen in FIG. 6B, another way to assess the size of the first portion 320 is by comparing heights. The height 333 of the first portion 320 is computed as the difference between the height 340 of the juncture point 324 to the pivot point 309 and a height 325 of proximal end 324 of the trailing edge 306 to the pivot point 309 (i.e. a height of the notch 330). In this embodiment, the height 333 of the first portion is about 60% of a height 340 of the trailing edge 306 (i.e. height of the blade 300). It is contemplated that in other embodiments the height 333 would be 90%, 85%, 80%, 75%, 70%, 65%, or even 40%, or any number in between of a height 340 of the blade 300. In this embodiment, the height 333 of the first portion 320 is about 3.36 inches and the height 340 is about 4.87 inches. In another embodiment, the height 333 is about 2.95 inches and the height 340 is about 3.7 inches.

The second portion 322 extends between the point 324 and the trailing end 312 of the base 302, and defines a notch 330 in the trailing edge 306 profile and also in the blade 300 profile. As seen in FIG. 7B, the notch 330 is sized to accommodate the proximal end 310 of the leading edge 304 of an adjacent blade 300 during pivoting about their pitch axis 102, thereby preventing interference with the adjacent blade 300.

The notch 330 is small compared to the trailing edge 306 and the blade 300. Similarly to the first portion 320, one way to evaluate the comparative size of the notch 330 involves comparing heights. In this embodiment, the notch 330 has a height 325 of about 1.24 inches when the height 340 is about 4.87 inches, which represents about 24% of the height 340 of the trailing edge 306. In another embodiment, the height 325 of about 0.75 inch when the height 340 is about 3.7 inches which represents about 20% of the height 340 of the trailing edge 306. Another way to estimate the size of the notch 330 is by comparing the length of the chord 337 with the length of the chord 336, as shown above for the first portion 320. Yet another way to assess the size of the notch 330 is by comparing surface areas of the notch 330 and of the blade 300. In this embodiment, a surface defined by the notch 330 has a surface area of about 1.62 square inches for a surface area of the blade 300 of about 27.4 square inches. Therefore, in terms of surface area, the notch 330 represents about 6% of the blade's 300 surface area. In another embodiment, the surface defined by the notch 330 has a surface area of about 2.5 square inches for a surface area of the blade 300 of about 37.6 square inches. Therefore, in that other embodiment, the notch 330 represents about 6.6% of the blade's 300 surface area. It is contemplated that the notch 330 could represent anywhere between 2 to 15% of the blade's 300 surface area.

The notch 330 is an indentation (or cut) in the blade 300 that represents a small piece of the blade 300 that has been removed from the blade 300. The notch 330 forms therefore a discontinuity in the trailing edge 306 profile and in the blade profile 300. The notch 330 is formed of two generally straight portions 326, 328 forming a V, while the first portion 320 of the trailing edge 306 and the leading edge 304 are generally curved. The straight portion 328 extends perpendicularly and slightly inwardly from the leading end 310 of the base 302, forming a first point of discontinuity at point 312. The straight portion 326 extends outwardly at an angle 332 (shown in FIG. 6A) from the straight portion 328 to meet with the first portion 320 at the point 324, forming a second point of discontinuity at point 324. In this embodiment, the angle 332 between the two straight portions 326, 328 is about 90 degrees. In another embodiment, the angle 332 between the two straight portions 326, 328 is about 122 degrees. It is contemplated that in various embodiments of the invention the angle 332 would be comprised between 70 and 145 degrees. It is also contemplated that the portions 326, 328 would not be straight, but would be concave or convex. It is also contemplated that in other embodiments of the invention the second portion 322 would not be V-shaped. For example, the second portion 322 would be formed of one straight portion and one rounded portion, a single straight or rounded portion, or more than two portions.

The shape of the notch 330 is dissimilar to a shape of the leading edge 304 of an adjacent blade 300. By dissimilar it should be understood that the shape of the notch 330 is not matching the shape of the leading edge 304 of the adjacent blade 300. It is contemplated that in other embodiments of the invention the shape of the notch 330 could be at least partially similar to the shape of at least a portion of the leading edge 306.

As best seen in FIG. 6B, the blade 300 has a height 340 shorter than a width 342. The height 340 of the blade 300 is computed by taking half of the difference between the diameter of the variable pitch propeller assembly 54 and the diameter of the hub 94. The width 342 of the blade 300 is the transversal span of the blade 300. It is the longest distance between the trailing edge 306 and the leading edge 304 when projected onto the rotation axis 206 of the propeller shaft 56. In this embodiment, the height 340 is about 4.87 inches, and the width 342 is about 6.44 inches. In another embodiment, the height 340 is 5.26 inches and the width 342 is about 7.23 inches. The height 340 is preferably between 2 inches and 7 inches, and the width 342 is preferably comprised between 4 inches and 12 inches. It is contemplated that in various embodiments the blade 300 could have the width 340 shorter than the height 342. A chord at the hub 347 is about 6 inches. The chord at the hub 347 is a chord joining the leading end 310 to the trailing end 312.

As best seen in FIG. 6C, in this embodiment the blade 300 is skewed at 30 degrees. In various other embodiments, the skew angle is between 20 degrees and 35 degrees. For example the skew angle could be 22 degrees, 33 degrees. In this embodiment, the skews angle of the blade 300 is lower than the ones of the prior art blades 300'. The blade 300' of the prior art have a higher skew angles (45 degrees and higher) to avoid interference between adjacent blades. Such a skew angle is not necessary in the blade 300 due to the presence of the notch 330.

In this embodiment, the blade 300 has a rake angle 344 of about 27.5 degrees. In various other embodiments, the rake angle 344 ranges from 0 to 45 degrees. For example, the rake angle 344 could be 25 degrees, 31 degrees, or 41 degrees. The blade 300 has a cup 346. It is contemplated that in other embodiments the blade 300 would not have a cup.

In this embodiment, the blade 300 has a pitch of 24 inches. In various other embodiments, the pitch ranges from 5 to 35 inches. For example the blade 300 could have a pitch of 5 inches, 7 inches, 13 inches, 22 inches, or 28 inches per revolution. The pitch is progressive. It is contemplated that in other embodiments the pitch could be constant.

The variable pitch propeller assembly 54 has a diameter of 14.5 inches. The diameter of the variable pitch propeller assembly 54 is comprised between 5 inches and 40 inches. For example the variable pitch propeller assembly 54 could have a diameter of 7 inches, 9.3 inches, 12.1 inches, 23 inches or 32.5 inches. The diameter of the variable pitch propeller assembly 54 is twice a radius 351 of the variable pitch propeller assembly 54 (shown in FIG. 6C). The hub 94 has a diameter of 4.75 inches. In other embodiment, the hub 94 diameter would be up to 12 inches, and preferably less than 6 inches. For example, the diameter of the hub 94 could be 1.6 inches, 2.73 inches, 3.31 inches, 7.61 inches or 9.23 inches. The diameter of the hub 94 is twice a radius 350 of the hub 94 (shown in FIGS. 6B and 6C).

Figure 7A:
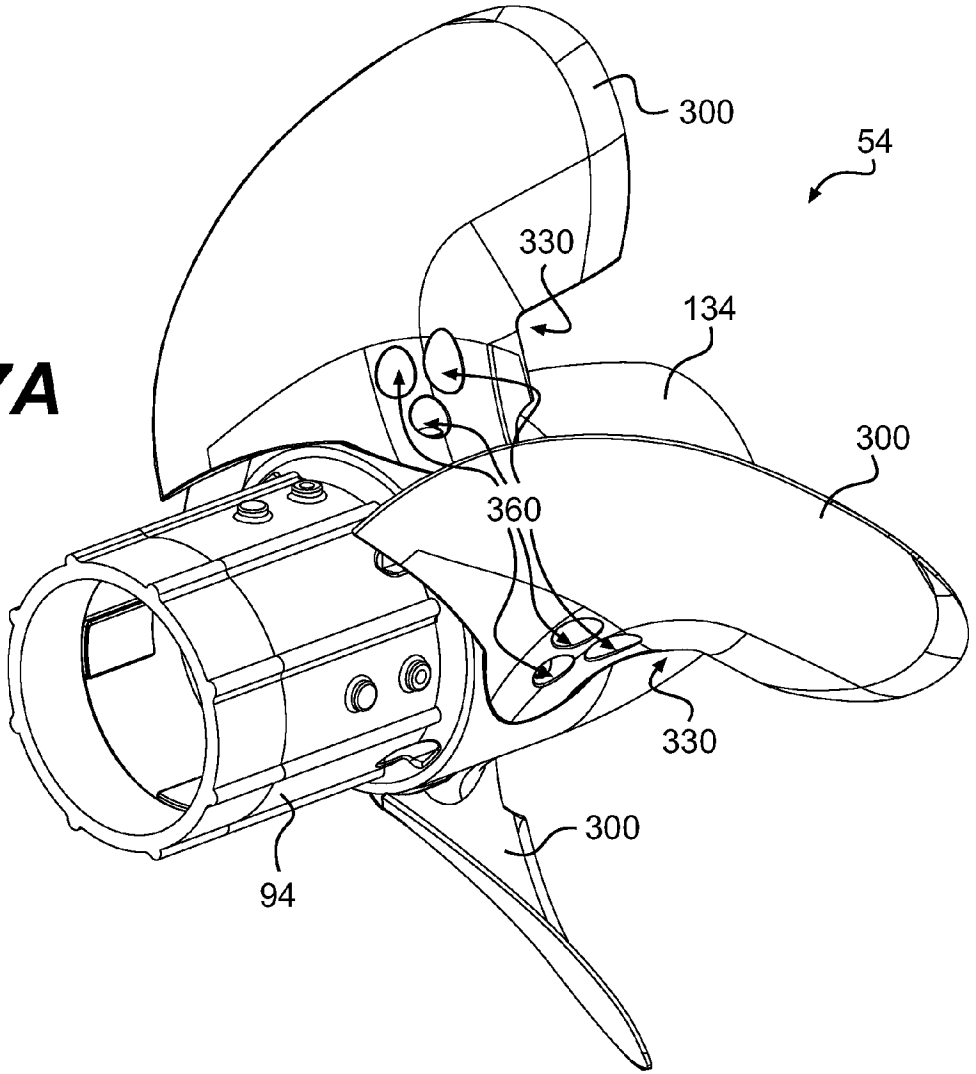
FIG. 7A is a front, left perspective view of the variable pitch propeller assembly of FIG. 4 showing the blades of FIG. 6A oriented when the cam in the first position.
Figure 7B:
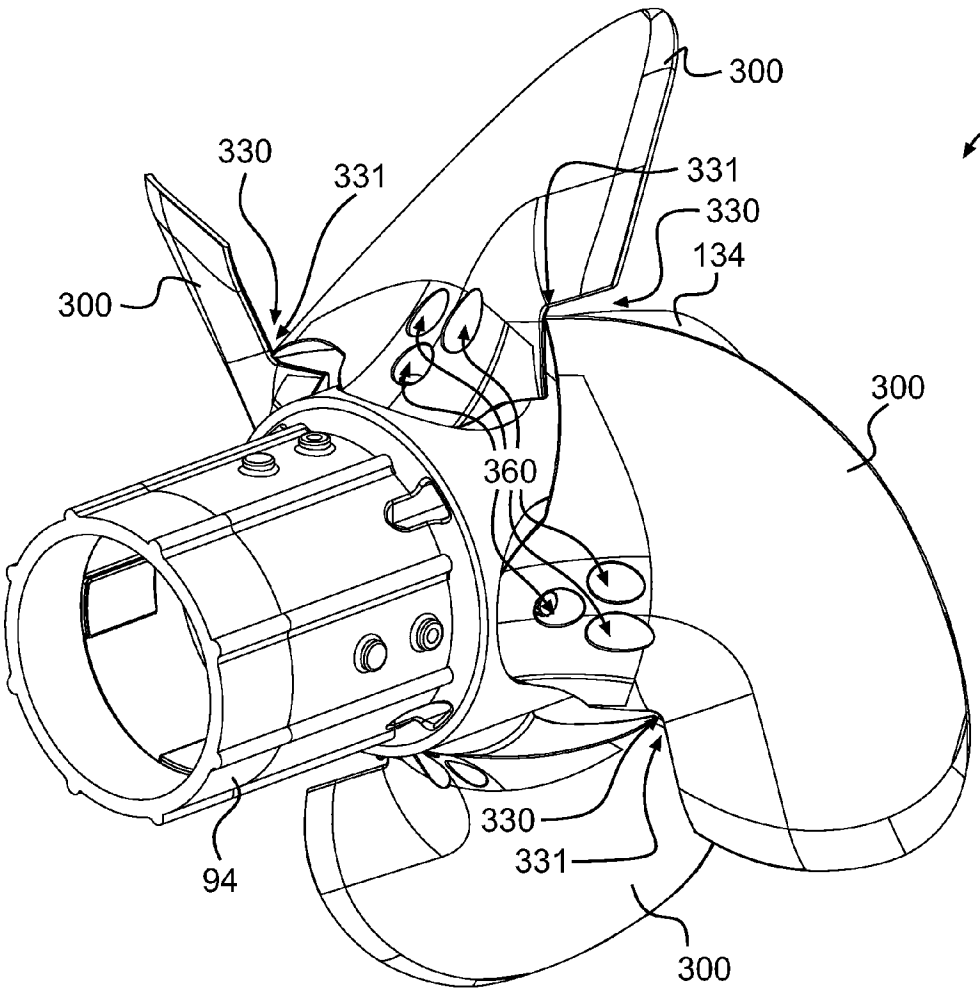
FIG. 7B is a front, left perspective view of the variable pitch propeller assembly of FIG. 4 showing the blades of FIG. 6A oriented when the cam in the second position.
Figure 7C:
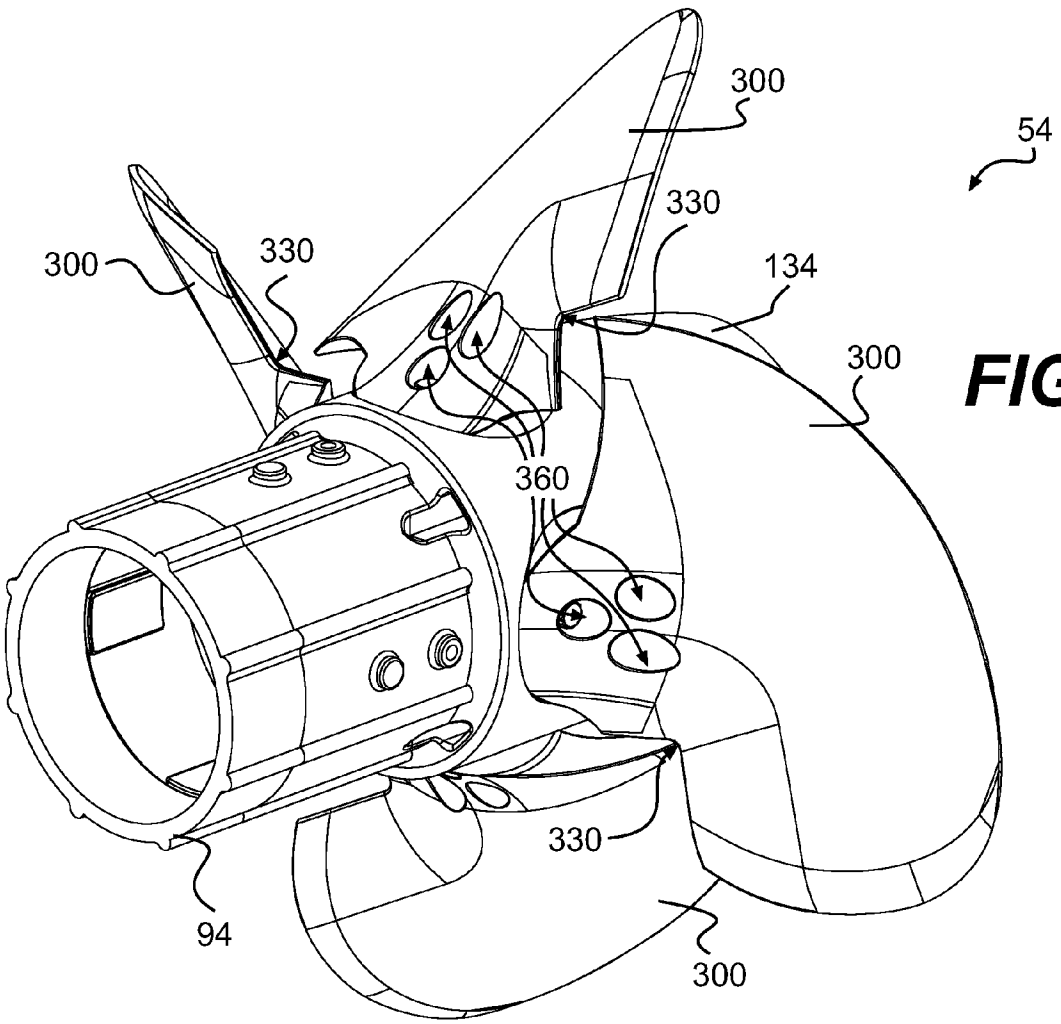
FIG. 7C is a front, left perspective view of the variable pitch propeller assembly of FIG. 4 showing the blades of FIG. 6A oriented when the cam in the third position.
Figure 8:
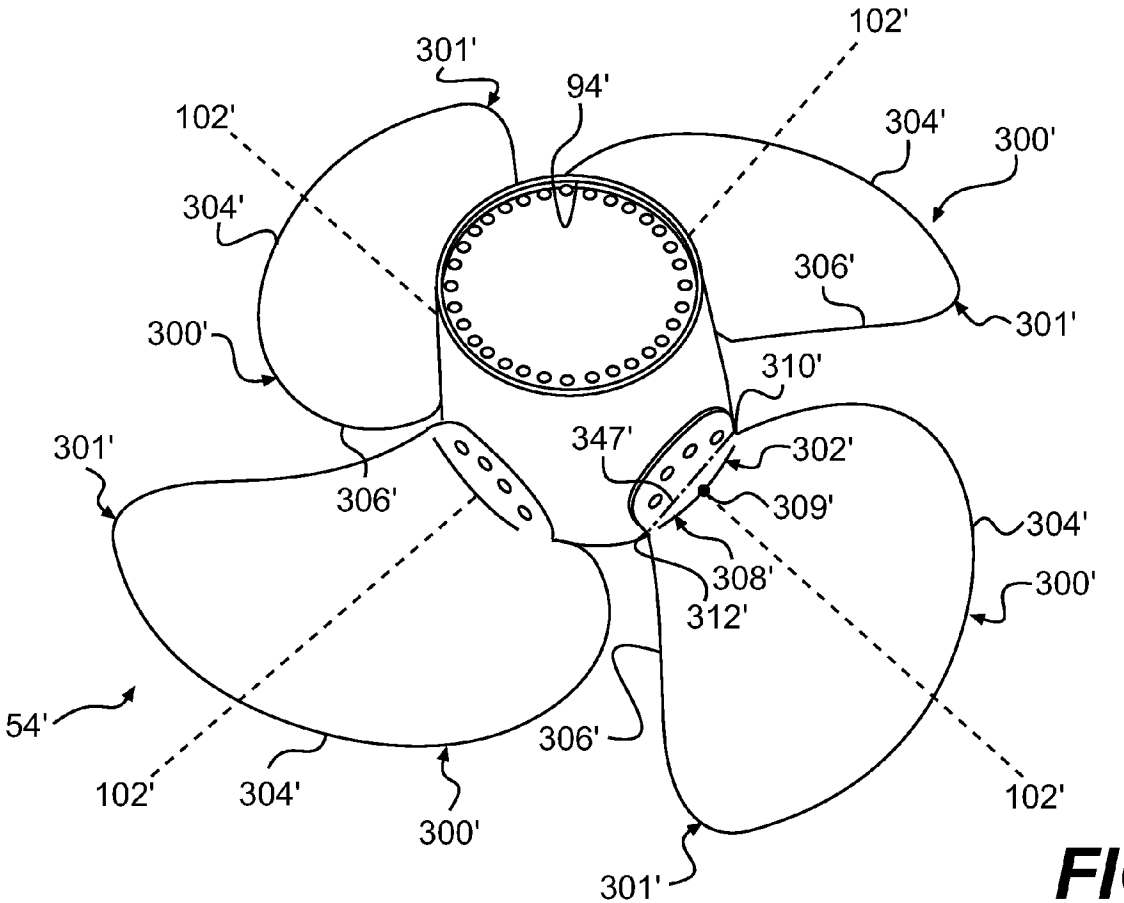
FIG. 8 PRIOR ART
FIG. 8 is a variable pitch propeller assembly showing blades of the prior art.

FIGS. 7A-7C show front, left perspective views of the propeller blades 300 mounted on the hub 94, and having a first pitch angle such as to provide a forward thrust, a second pitch angle during pass-by and a third pitch angle such as to provide a rearward thrust. In one embodiment, the pitch angle range between a maximum pitch angle for which the variable pitch propeller assembly 54 produces a forward thrust, and a maximum pitch angle for which the variable pitch propeller assembly 54 produces a rearward thrust is −60 degrees. It is contemplated that the pitch angle range could be less than 60 degrees.

In FIG. 7A, the leading edges 304 are positioned partially forward from the trailing edges 306. The variable pitch propeller assembly 54 generates a forward thrust. In FIG. 7B, the proximal ends of the leading edges 304 enter into the notch 330 defined in the trailing edges 306 without interfering. In FIG. 7C, the leading edges 304 are positioned partially rearward of the trailing edges 306. The variable pitch propeller assembly 54 generates a rearward thrust. FIG. 7B also shows the blades 300 of the variable pitch propeller assembly 54 area spaced from each other by a clearance 331. The clearance 331 is defined between the leading edge 304 of one blade 300 and the notch 330 of an adjacent blade. The clearance 331 is preferably designed to be a minimal distance between two adjacent blades 300 in pass-by that takes into account tolerance and deflection.

Any one of a number standard techniques that are known in the art in association with convention variable pitch propeller blades for these types of engines are used to manufacture the invention.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A variable pitch propeller suitable for use in association with a marine internal combustion engine, the propeller comprising:

a hub; and a plurality of blades, each of the plurality of blades being pivotally connected to the hub so as to pivot about a pitch axis between a first pitch angle and a second pitch angle, the first pitch angle corresponds to a pitch angle for which the variable pitch propeller produces a forward thrust, the second pitch angle corresponds to a pitch angle for which the variable pitch propeller produces a negative thrust, each of the plurality of blades having:

a base having a leading end and a trailing end;

a leading edge having a distal end and a proximal end, the proximal end of the leading edge joining the leading end of the base; and a trailing edge having a distal end and a proximal end, the distal end of the trailing edge joining the distal end of the leading edge, the proximal end of the trailing edge joining the trailing end of the base, the trailing edge having a portion defining a notch therein forming a discontinuity in a profile of the trailing edge, the notch being sized and shaped so as to accommodate passage therethrough of a portion of the leading edge of an adjacent blade when the blade and the adjacent blade are pivoted between the first pitch angle and the second pitch angle;

each of the blades of the plurality of having an intermediate position intermediate the first pitch angle and the second pitch angle, in the intermediate positions of the plurality of blades, the proximal end of the leading edge of one of the plurality of blades being disposed radially between the hub and the portion of the trailing edge of another one of the plurality of blades defining the notch the other one of the plurality of the blades being adjacent the one of the plurality of the blades, the propeller having a diameter of less than 40 inches.

2. The variable pitch propeller of claim 1, wherein the propeller rotates about a propeller axis;

a longest distance between the trailing edge and the leading edge when projected onto the propeller axis defines a width of the blade;

half of a difference between the diameter of the propeller and a diameter of the hub defines a height of the blade; and the height of the blade is shorter than the width of the blade.

3. The variable pitch propeller of claim 1, wherein the propeller rotates about a propeller axis;

the base has a portion connecting to the hub;

the portion has a first end and a second end; and a distance parallel to the propeller axis between the first end and the second end of the portion of the base is shorter than another distance parallel to the propeller axis between the leading end and the trailing end of the base.

4. The variable pitch propeller of claim 1, wherein the propeller rotates about a propeller axis, a longest distance parallel to the propeller axis between the trailing edge and the leading edge defines a width of the blade;

the pitch axis intersects the base at a pivot point; and another distance parallel to the propeller axis between the pivot point and the leading end of the base is longer than half of the width of the blade.

5. The variable pitch propeller of claim 1, wherein the base has a connecting portion for connecting to the hub, the base has a leading portion extending between the connecting portion and the leading end, and when the first pitch angle is at a maximum angle for producing a forward thrust a curvature of the leading portion of the base follows at least partially a curvature of an external surface of the hub.

6. The variable pitch propeller of claim 1, wherein the distal end of the trailing edge connects the distal end of the leading edge at a juncture point;

the notch has a distal end and a proximal end, the proximal end of the notch being the proximal end of the trailing edge;

the pitch axis intersects the base at a pivot point; and a length of a chord between the pivot point and the distal end of the notch is at most 80% of a length between the juncture point and the pivot point.

7. The variable pitch propeller of claim 1, wherein the propeller rotates about a propeller axis;

the pitch axis is perpendicular to the propeller axis;

the pitch axis intersects the base at a pivot point;

the distal end of the trailing edge connects the distal end of the leading edge at a juncture point;

the notch has a distal end and a proximal end;

the proximal end of the notch is the proximal end of the trailing edge;

and a distance parallel to the pitch axis between the distal end of the notch and the pivot point is at most 60% of another distance parallel to the pitch axis between the juncture point and the pivot point.

8. The variable pitch propeller of claim 1, wherein the notch of each of the plurality of blades has two generally straight portions forming a V.

9. The variable pitch propeller of claim 1, wherein the plurality of blades comprises between 3 and 5 blades.

10. The variable pitch propeller of claim 1, wherein adjacent blades of the plurality of blades are separated by a clearance gap, the clearance gap preventing contact between at least a portion of the leading edges and the trailing edges of the adjacent blades.

* * * * *

UNITED STATES PATENT AND TRADEMARK OFFICE

CERTIFICATE OF CORRECTION

PATENT NO. : 8,951,018 B1
APPLICATION NO. : 13/016569
DATED : February 10, 2015
INVENTOR(S) : Dave Calamia et al.

It is certified that error appears in the above-identified patent and that said Letters Patent is hereby corrected as shown below:

In The Claims

Claim 1, Column 17, line 46, "the notch the other" should read -- the notch, the other --.

Signed and Sealed this
Twenty-third Day of June, 2015

Michelle K. Lee

Michelle K. Lee
*Director of the United States Patent and Trademark Office*